US011371226B2

(12) United States Patent
Nelson

(10) Patent No.: US 11,371,226 B2
(45) Date of Patent: Jun. 28, 2022

(54) DRAIN STOPPER APPARATUS

(71) Applicant: Brent F. Nelson, Glendora, CA (US)

(72) Inventor: Brent F. Nelson, Glendora, CA (US)

( * ) Notice: Subject to any disclaimer, the term of this patent is extended or adjusted under 35 U.S.C. 154(b) by 0 days.

(21) Appl. No.: 17/086,654

(22) Filed: Nov. 2, 2020

(65) Prior Publication Data

US 2021/0324618 A1 Oct. 21, 2021

Related U.S. Application Data

(62) Division of application No. 16/852,688, filed on Apr. 20, 2020, now Pat. No. 10,858,813.

(51) Int. Cl.
*E03C 1/23* (2006.01)

(52) U.S. Cl.
CPC ..... *E03C 1/2302* (2013.01); *E03C 1/2306* (2013.01)

(58) Field of Classification Search
CPC .... E03C 1/2304; E03C 1/2302; E03C 1/2306; E03C 1/23
USPC ..... 4/689
See application file for complete search history.

(56) References Cited

U.S. PATENT DOCUMENTS

| | | | | |
|---|---|---|---|---|
| 2,179,121 | A * | 11/1939 | Klein | E03C 1/2304 4/689 |
| 3,159,179 | A | 12/1964 | De Lain | |
| 3,787,022 | A | 1/1974 | Wilcox | |
| 4,596,057 | A * | 6/1986 | Ohta | E03C 1/2304 4/689 |
| 6,375,155 | B1 | 4/2002 | Janssens | |
| 8,528,122 | B2 | 9/2013 | Ball et al. | |
| 8,925,578 | B2 | 1/2015 | Lee | |
| 10,858,813 | B1 * | 12/2020 | Nelson | E03C 1/2306 |
| 10,876,638 | B2 * | 12/2020 | Moens | F04C 29/124 |
| 2009/0158522 | A1 * | 6/2009 | Wu | E03C 1/2304 4/689 |
| 2009/0255041 | A1 | 10/2009 | Duncan | |
| 2010/0138985 | A1 | 6/2010 | Duncan | |
| 2010/0282995 | A1 | 11/2010 | Cen | |
| 2014/0059761 | A1 | 3/2014 | Bohacik et al. | |

FOREIGN PATENT DOCUMENTS

| | | |
|---|---|---|
| WO | 1997/035507 | 10/1997 |

* cited by examiner

*Primary Examiner* — Huyen D Le
(74) *Attorney, Agent, or Firm* — Master Key IP, LLP; Justin G. Sanders

(57) ABSTRACT

A drain stopper apparatus is disclosed and configured for being installed within a drain hole of a fixture, for preventing any buildup of hair or other materials within an associated drainpipe of the fixture. In at least one embodiment, the apparatus provides a stopper body sized and shaped for being positioned within the drain hole of the fixture, in contact with an inner surface of a basin of the fixture. A stopper tailpiece is engaged with a bottom of the stopper body. A stopper is positioned within the stopper body and configured for selectively moving between one of an open position and a closed position. A drive coupler interconnects a lower end of the stopper tailpiece with an upper end of the drainpipe, the drive coupler providing a drive mechanism positioned and configured for selectively actuating the stopper between the open and closed positions.

11 Claims, 17 Drawing Sheets

122
100
98
100
86
86
96
26
96
86
28
42
80
72
72

DRAIN STOPPER APPARATUS

RELATED APPLICATIONS

This is a divisional application and so claims the benefit pursuant to 35 U.S.C. § 120 of a prior filed and co-pending U.S. non-provisional patent application Ser. No. 16/852,688, filed on Apr. 20, 2020. The contents of the aforementioned application are incorporated herein by reference.

BACKGROUND

The subject of this patent application relates generally to drain stoppers, and more particularly to a drain stopper apparatus configured for keeping the drainpipe substantially unobstructed when the apparatus is in an open position, thereby preventing any buildup of hair or other materials therewithin.

Applicant hereby incorporates herein by reference any and all patents and published patent applications cited or referred to in this application.

By way of background, as illustrated in the prior art diagram of FIG. 1, traditional drain stoppers (for sinks, bathtubs, etc.) often utilize a pop-up device positioned within the drainpipe and configured for being selectively moved between a closed position (whereby a cap and gasket at the top of the pop-up creates a seal around the drainpipe opening), and an open position (whereby the cap is elevated a distance above the drainpipe opening for allowing water to pass therethrough). While such stoppers are effective at selectively stopping water from going down the drain, they also tend to create potential clogs by providing structures positioned within the drainpipe on which hair and other materials can collect over time. Accordingly, there remains a need for an apparatus that achieves the same functionality as traditional drain stoppers without the use of any structures or mechanisms within the drainpipe itself that would collect hair or other materials within the drainpipe.

Aspects of the present invention fulfill these needs and provide further related advantages as described in the following summary.

It should be noted that the above background description includes information that may be useful in understanding aspects of the present invention. It is not an admission that any of the information provided herein is prior art or relevant to the presently claimed invention, or that any publication specifically or implicitly referenced is prior art.

SUMMARY

Aspects of the present invention teach certain benefits in construction and use which give rise to the exemplary advantages described below.

The present invention solves the problems described above by providing a drain stopper apparatus configured for being installed within a drain hole of a fixture, the drain hole in fluid communication with a drainpipe. In at least one embodiment, the apparatus provides a stopper body sized and shaped for being positioned within the drain hole of the fixture, in contact with an inner surface of a basin of the fixture. A stopper tailpiece is engaged with a bottom of the stopper body. A stopper is positioned within the stopper body and configured for selectively moving between one of an open position—wherein fluid is able to freely flow down through each of the stopper body, stopper tailpiece and drainpipe—and a closed position—wherein fluid is prevented from flowing down through the stopper body. A drive coupler interconnects a lower end of the stopper tailpiece with an upper end of the drainpipe, the drive coupler providing a drive mechanism positioned and configured for selectively actuating the stopper between the open and closed positions. The drive mechanism provides a pivot rod pivotally mounted proximally to an outer surface of the drive coupler at a pivot point. A pair of cables extend between the pivot rod and the stopper within an enclosed cable passage positioned within the stopper tailpiece, with a first end of each cable attached to the pivot rod so as to flank the pivot point, and an opposing second end of each cable attached to the stopper, wherein as the pivot rod pivots back and forth about the pivot point, the cables move in a pull/follow fashion which, in turn, cause the stopper to move between the open position and closed position. As a result, the stopper body, stopper tailpiece, drive coupler and drainpipe remain substantially unobstructed when the stopper is in the open position, thereby preventing any buildup of hair or other materials therewithin as fluid flows therethrough.

In at least one alternate embodiment, the apparatus provides a stopper body sized and shaped for being positioned within the drain hole of the fixture, in contact with an inner surface of a basin of the fixture. A stopper tailpiece is engaged with a bottom of the stopper body. A drive coupler interconnects a lower end of the stopper tailpiece with an upper end of the drainpipe. A stopper of the apparatus provides an inner pipe coaxially and slidably positioned within the stopper body and stopper tailpiece, the inner pipe sized and configured for selectively allowing fluid to freely flow down through each of the inner pipe, drive coupler and drainpipe. The inner pipe has an outer diameter that approximates an inner diameter of the stopper tailpiece, with a lower end of the inner pipe extending a distance beyond a lower end of the stopper tailpiece. A cap is positioned on an upper end of the inner pipe. An at least one aperture is positioned on a sidewall of the inner pipe, below the cap. The drive coupler provides a drive mechanism mechanically linked to an outer surface of the inner pipe at a point below the lower end of the stopper tailpiece. The drive mechanism provides a pivot rod pivotally mounted proximally to an outer surface of the drive coupler at a pivot point. Thus, as the pivot rod pivots back and forth about the pivot point, the drive mechanism is configured for selectively moving the stopper vertically relative to the stopper body between one of a closed position—wherein the cap creates a fluid-tight seal with the stopper body—and an open position—wherein the cap is elevated a distance above a top surface of the stopper body, thereby exposing the at least one aperture in the sidewall of the inner pipe, allowing fluid to freely flow therethrough, into the inner pipe and down into the drainpipe, with the stopper body, stopper tailpiece, drive coupler, inner pipe and drainpipe remaining substantially unobstructed when the stopper is in the open position, thereby preventing any buildup of hair or other materials therewithin as fluid flows therethrough.

In at least one further alternate embodiment, the apparatus provides a stopper body sized and shaped for being positioned within the drain hole of the fixture, in contact with an inner surface of a basin of the fixture. A stopper tailpiece is engaged with a bottom of the stopper body and extending a distance into the drain hole, the stopper tailpiece having an outer diameter that is relatively smaller than an inner diameter of the drain hole. A stopper is positioned within the stopper body and configured for selectively moving between one of an open position—wherein fluid is able to freely flow down through each of the stopper body, stopper tailpiece and drainpipe—and a closed position—wherein fluid is prevented from flowing down through the stopper body. An electric motor is positioned within the stopper body and mechanically linked to the stopper for selectively moving the stopper between the open position and closed position. As a result, the stopper body, stopper tailpiece and drainpipe remain substantially unobstructed when the stopper is in the open position, thereby preventing any buildup of hair or other materials therewithin as fluid flows therethrough.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
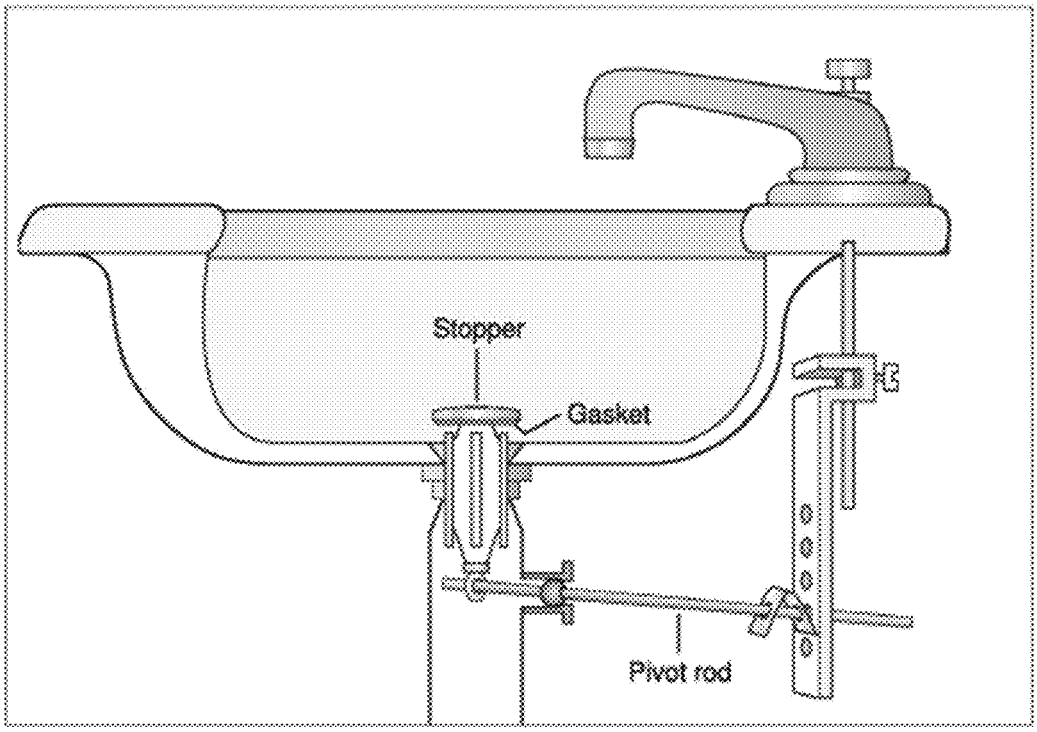
Fig. 1 (prior art)
FIG. 1 is a side diagrammatic view of an exemplary sink incorporating a prior art drain stopper.
Figure 2:
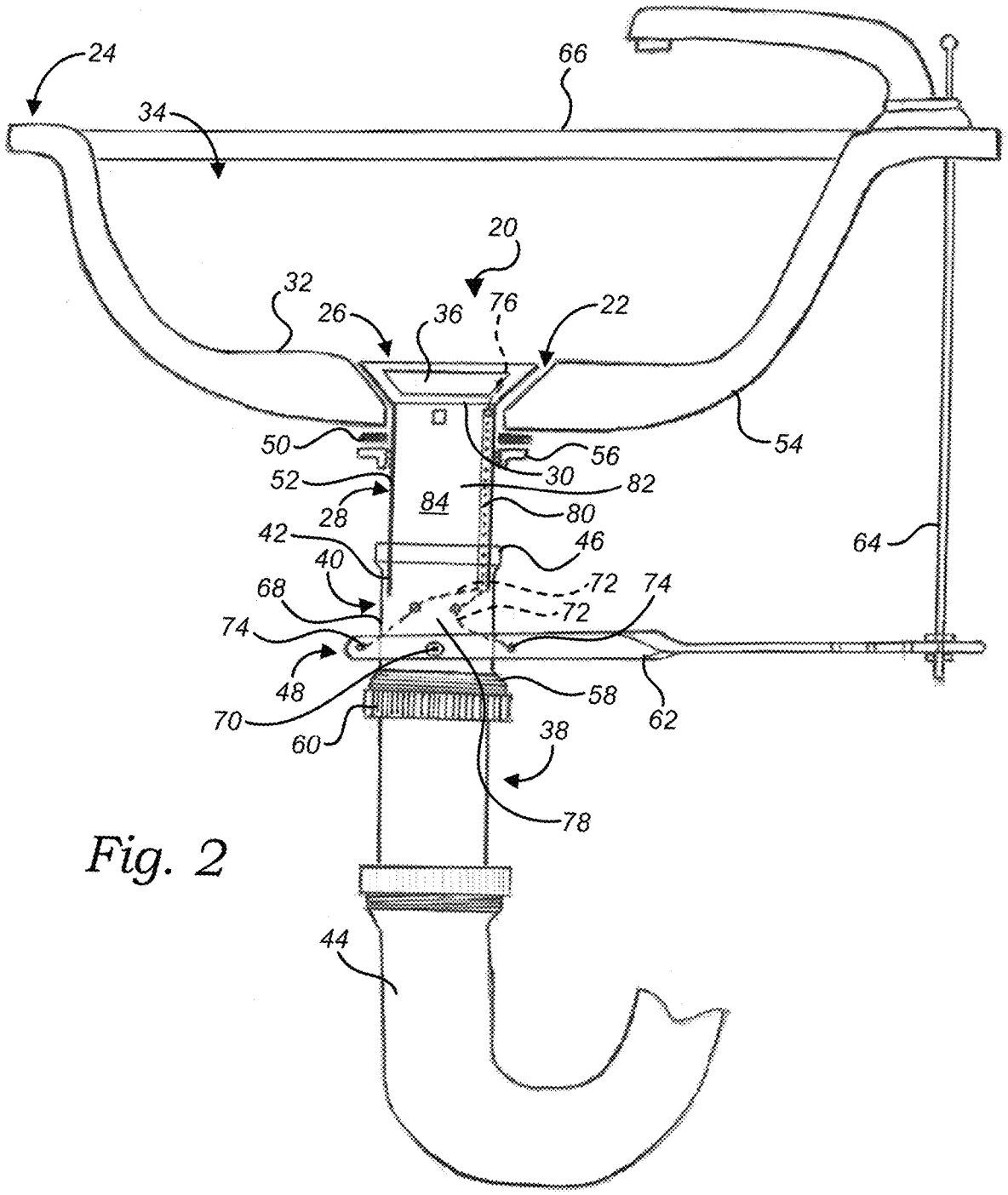
FIG. 2 is a side diagrammatic view of an exemplary drain stopper apparatus, in accordance with at least one embodiment.

Turning now to FIG. 2, there is shown a side diagrammatic view of an exemplary drain stopper apparatus 20 positioned within a drain hole 22 of an exemplary fixture 24, in accordance with at least one embodiment. At the outset, it should be noted that while the fixture 24 is shown and described herein as being a sink for illustrative purposes, the apparatus 20 may be utilized in the drain hole 22 of any other type of fixture 24, now known or later developed, where there is a need for a drain stopper that prevents hair or other materials from collecting thereon or within—such as tubs, for example. Thus, the apparatus 20 is in no way limited to being used only in sinks.

With continued reference to FIG. 2, in at least one embodiment, the apparatus 20 provides a stopper body 26 and a stopper tailpiece 28 attached to a bottom 30 of the stopper body 26. In at least one embodiment, the stopper body 26 is integral with the stopper tailpiece 28. In at least one alternate embodiment, the bottom 30 of the stopper body 26 is removably engagable with the stopper tailpiece 28, using a threadable or frictional engagement for example—though removable engagement between the stopper body 26 and stopper tailpiece 28 may be achieved using any other mechanism or material, now known or later developed, in further embodiments. In at least one embodiment, as discussed in detail below, the stopper body 26 is sized and shaped for being positioned within the drain hole 22 of the fixture 24, in contact with an inner surface 32 of a basin 34 of the fixture 24, similar to a traditional flange. Additionally, in at least one embodiment, the stopper body 26 is sized and configured for housing a stopper 36 capable of moving between one of an open position—wherein fluid is able to freely flow down through each of the stopper body 26 and stopper tailpiece 28, into a drainpipe 38 in fluid communication with the fixture 24—and a closed position—wherein fluid is prevented from flowing down through the stopper body 26—as discussed further below.

In at least one embodiment, the apparatus 20 further provides a drive coupler 40 attached to a lower end 42 of the stopper tailpiece 28 and configured for interconnecting the apparatus 20 with the drainpipe 38. In at least one embodiment, depending on the respective lengths of the stopper tailpiece 28 and the drive coupler 40 as compared to the dimensions of the space in which the fixture 24 is positioned, the drive coupler 40 may alternatively interconnect the apparatus 20 with a trap 44 of the fixture 24. Accordingly, for simplicity purposes, the term "drainpipe" as used herein is intended to include both the drainpipe 38 as well as the trap 44. In at least one embodiment, the drive coupler 40 is integral with the stopper tailpiece 28—or alternatively, the drive coupler 40 and stopper tailpiece 28 may be one and the same. In at least one alternate embodiment, an upper end 46 of the drive coupler 40 is removably engagable with the lower end 42 of the stopper tailpiece 28, using a threadable or frictional engagement for example—though removable engagement between the drive coupler 40 and stopper tailpiece 28 may be achieved using any other mechanism or material, now known or later developed, in further embodiments. In at least one embodiment, the drive coupler 40 is further configured for housing or otherwise supporting a drive mechanism 48 positioned and configured for selectively actuating the stopper 36 and moving it between the open and closed positions, as discussed further below.

Figure 3:
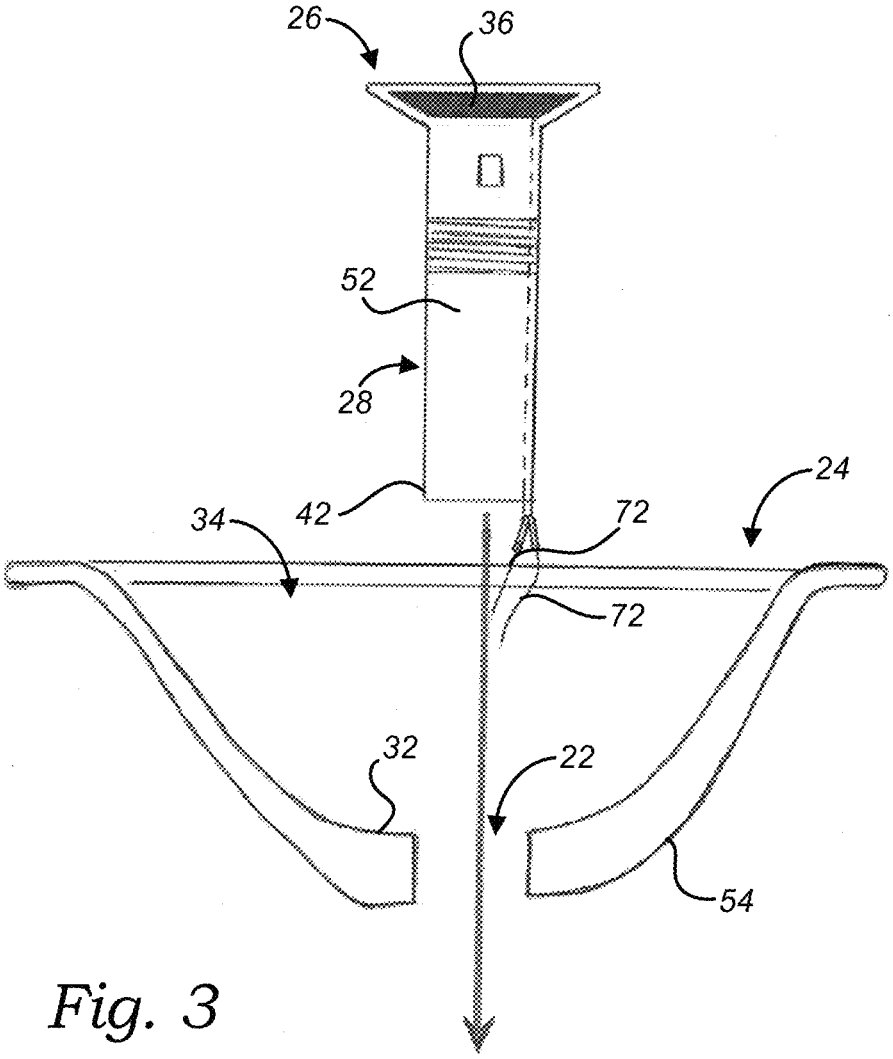
FIGS. 3-5 are side views illustrating an exemplary process of installing the drain stopper apparatus of FIG. 2 in an exemplary sink, in accordance with at least one embodiment.
Figure 4:
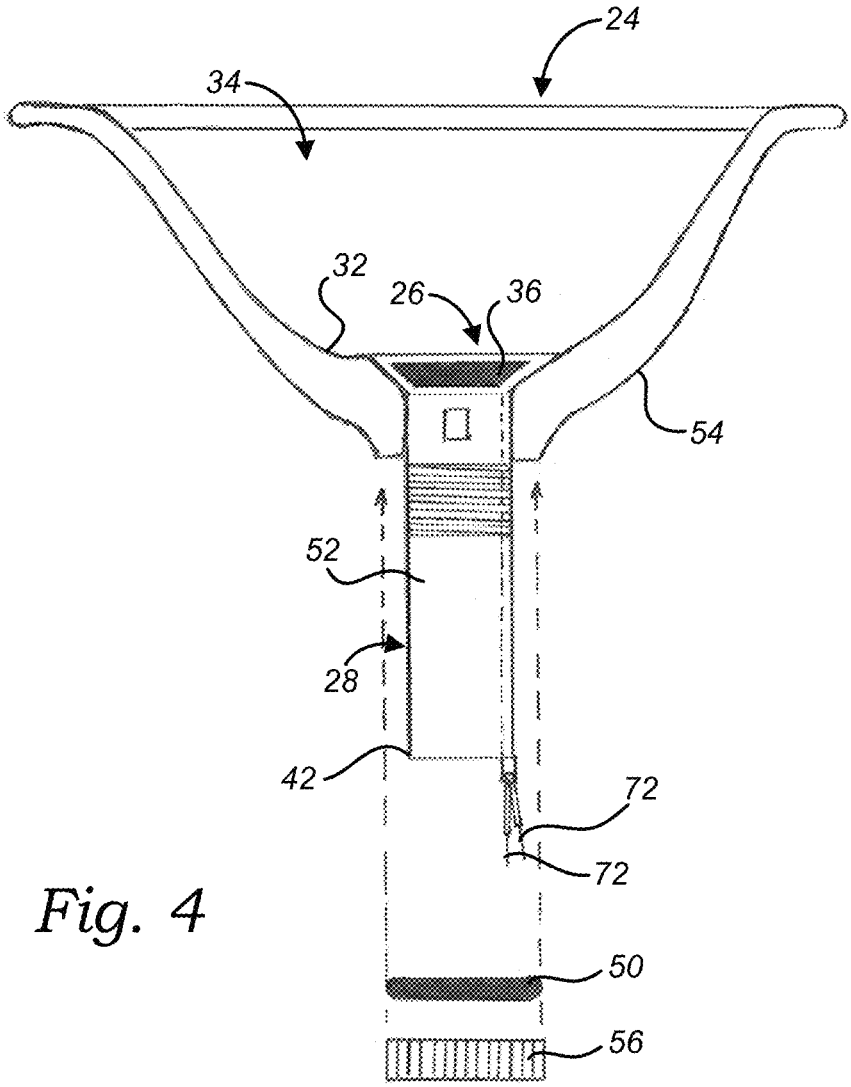
Figure 5:
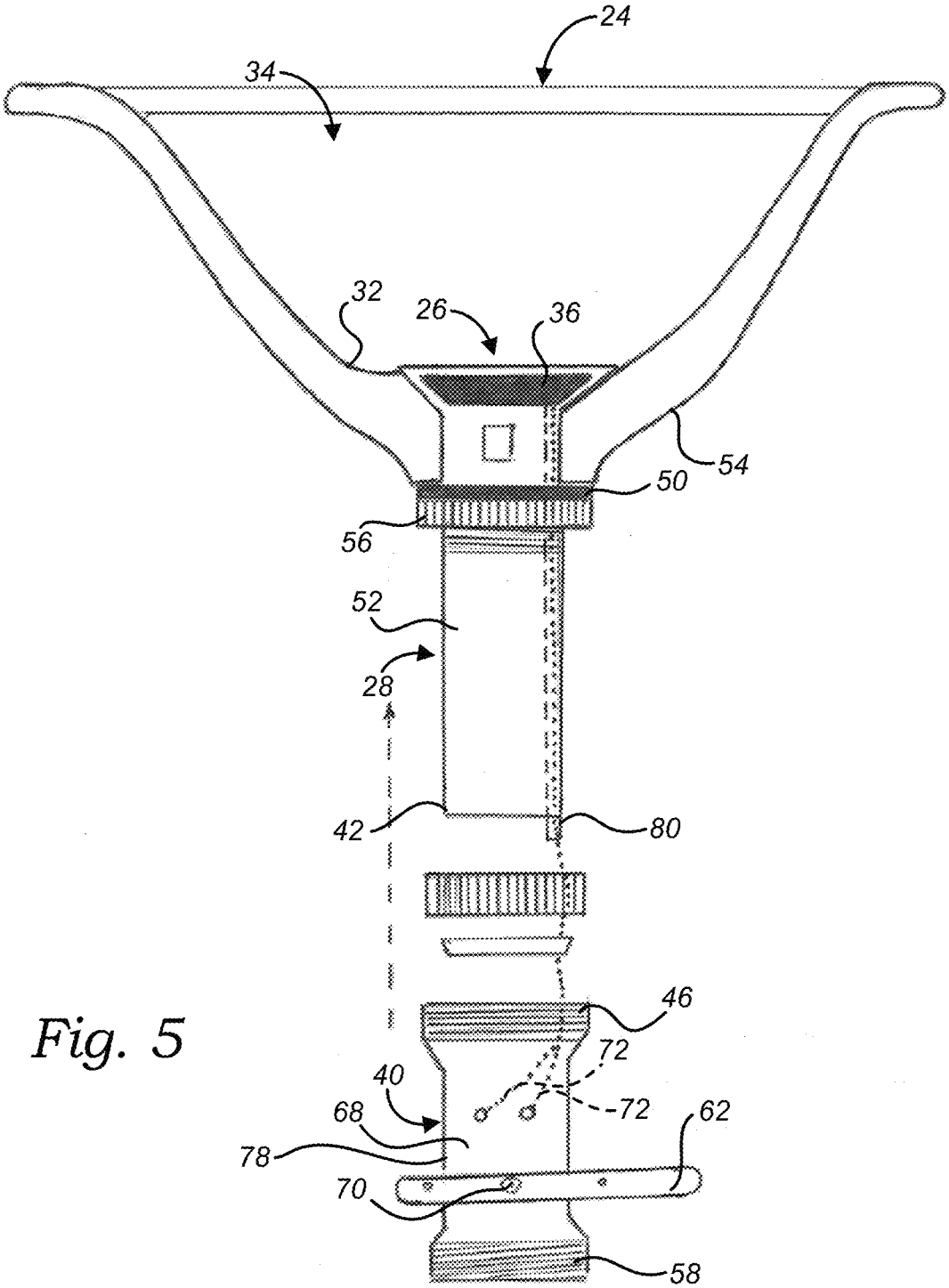

In at least one embodiment, as illustrated in FIGS. 3-5, the apparatus 20 is installed within the fixture 24 by first inserting the stopper tailpiece 28 down through the drain hole 22 (FIG. 3) so that the lower end 42 of the stopper tailpiece 28 extends a distance below the basin 34 of the fixture 24. A gasket 50 is then slidably engaged with an outer surface 52 of the stopper tailpiece 28 and positioned in abutting contact with an outer surface 54 of the basin 34, while a jam nut 56 is threadably engaged with the outer surface 52 of the stopper tailpiece 28, thereby tightening the stopper body 26 against the inner surface 32 of the basin 34 (FIG. 4). The upper end 46 of the drive coupler 40 is engaged with the lower end 42 of the stopper tailpiece 28 (FIG. 5), while a lower end 58 of the drive coupler 40 is engaged with the drainpipe 38 using a coupling nut 60—though removable engagement between the drive coupler 40 and the drainpipe 38 may be achieved using any other mechanism or material, now known or later developed, in further embodiments. In further embodiments, the apparatus 20 may be installed using other methods, techniques and/or mechanisms—dependent at least in part on the particular fixture 24 in which the apparatus 20 is to be installed.

As noted above, the drive coupler 40 is configured for housing or otherwise supporting a drive mechanism 48 positioned and configured for selectively actuating the stopper 36 and moving it between the open and closed positions. In at least one embodiment, as illustrated in FIG. 2, the drive mechanism 48 provides a pivot rod 62 pivotally engaged proximally with the drive coupler 40, and attached distally to a pull rod 64. The pull rod 64 is accessible from a top surface 66 of the fixture 24, thereby allowing the pull rod 64 to be manually pulled and pushed which, in turn, pivots the pivot rod 62 relative to the drive coupler 40. In further embodiments, other mechanisms capable of selectively actuating the pivot rod 62, now known or later developed, may be substituted.

In at least one embodiment, the pivot rod 62 is pivotally mounted to an outer surface 68 of the drive coupler 40 at a pivot point 70. Additionally, in at least one embodiment, a pair of cables 72 are attached at a first end 74 to the pivot rod 62 so as to flank the pivot point 70, while an opposing second end 76 of each cable 72 is attached to the stopper 36. Thus, as the pivot rod 62 pivots back and forth about the pivot point 70, the cables 72 move in a pull/follow fashion which, in turn, cause the stopper 36 to move between the open and closed positions, as discussed further below. In at least one embodiment, as illustrated in FIG. 2, the cables 72 extend through a sidewall 78 of the drive coupler 40 (via grommets or other fluid-tight apertures) and run within an enclosed cable passage 80 positioned within stopper tailpiece 28, thus leaving the stopper tailpiece 28, drive coupler 40 and drainpipe 38 free of any internal structure or components upon which hair or other materials may collect as fluid flows therethrough. In at least one such embodiment, the cable passage 80 is positioned within a sidewall 82 of the stopper tailpiece 28. In at least one alternate embodiment, the cable passage 80 is a separate, relatively small diameter tube that runs along an inner surface 84 of the stopper tailpiece 28.

Figure 6:
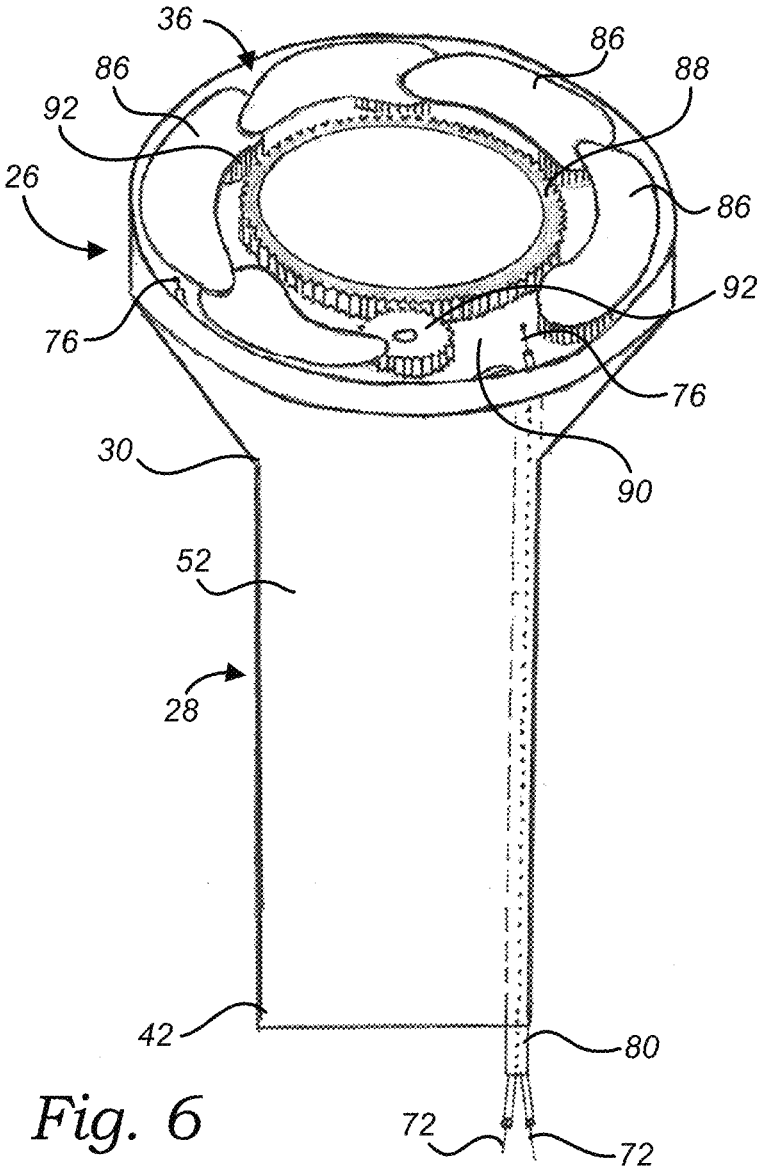
FIG. 6 is a perspective view of the drain stopper apparatus of FIG. 2, in accordance with at least one embodiment.
Figure 7A:
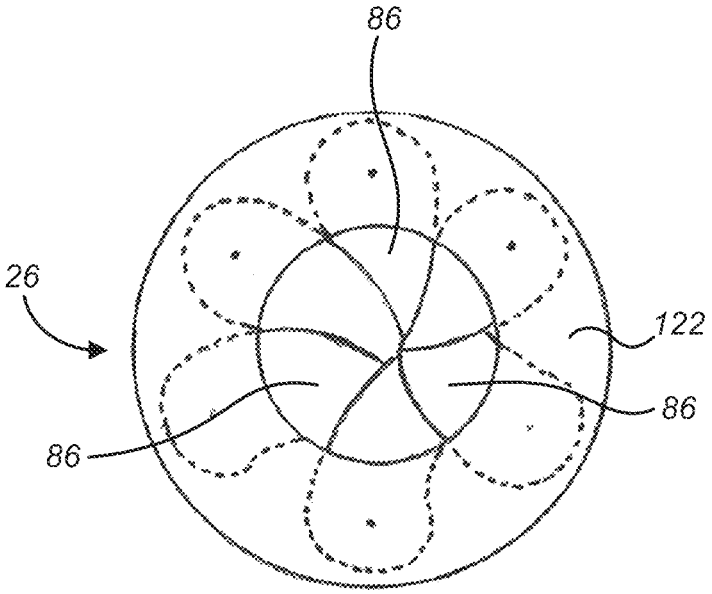
FIG. 7A is a top plan view of the drain stopper apparatus of FIG. 2 in a closed position, in accordance with at least one embodiment.
Figure 7B:
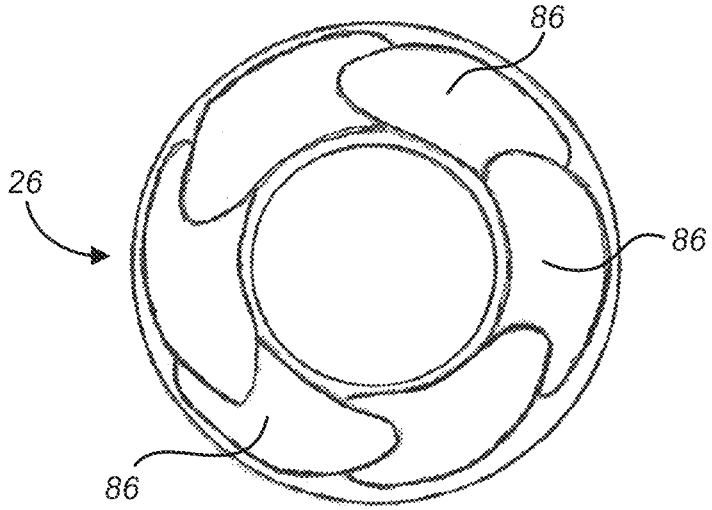
FIG. 7B is a top plan view of the drain stopper apparatus of FIG. 2 in an open position, in accordance with at least one embodiment.
Figure 8:
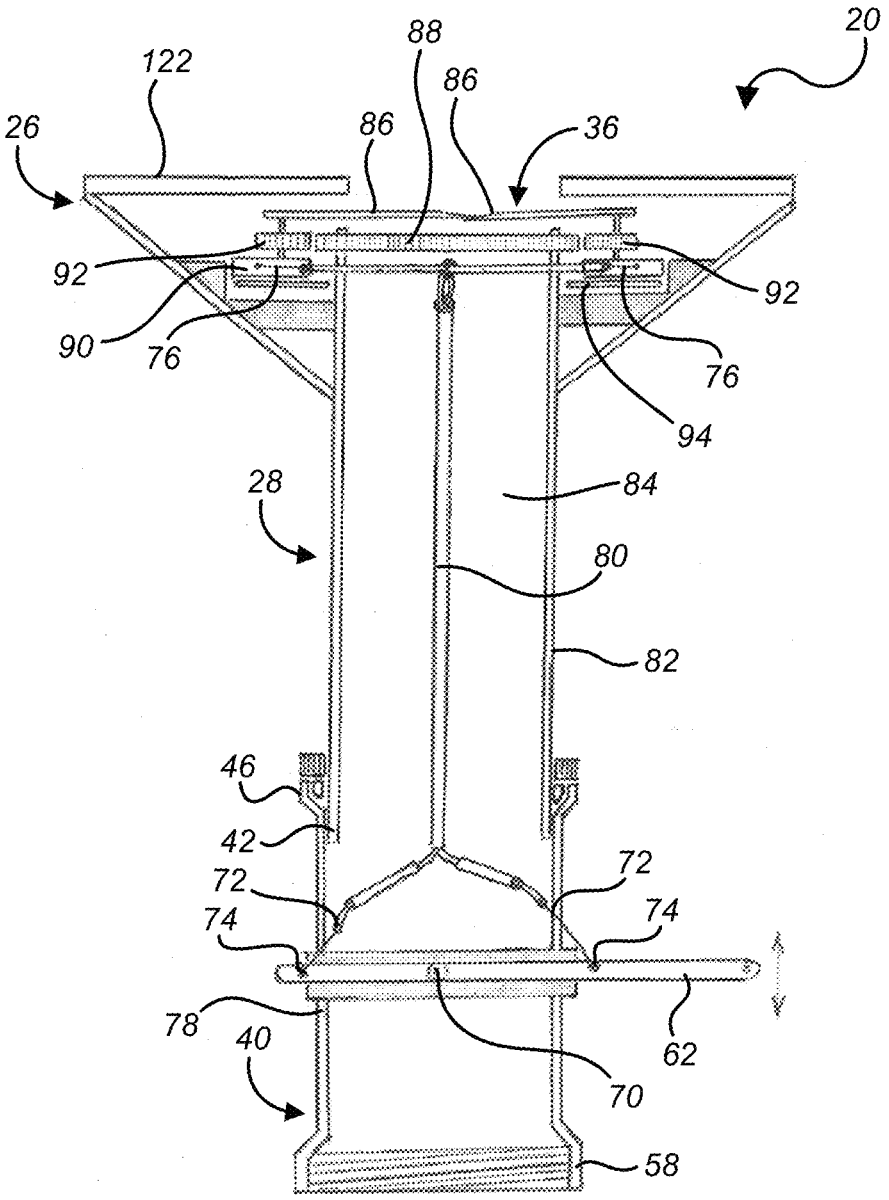
FIG. 8 is a cross-sectional view of the drain stopper apparatus of FIG. 2, in accordance with at least one embodiment.

In at least one embodiment, as illustrated in FIG. 6, the stopper 36 is a mechanical iris comprising a plurality of radially arranged rotatable flaps 86. In such embodiments, when the stopper 36 is in the closed position (FIG. 7A), the flaps 86 are rotated inwardly and cooperate to form a fluid-tight seal, thereby preventing fluid from flowing down through the stopper body 26; and when the stopper 36 is in the open position (FIG. 7B), the flaps 86 are rotated outwardly, thereby allowing fluid to freely flow down through each of the stopper body 26 and stopper tailpiece 28, into the drainpipe 38. In at least one such embodiment, as illustrated in FIG. 6 along with the cross-sectional view of FIG. 8, the stopper 36 provides a stationary central gear 88 surrounded by a selectively rotatable satellite ring 90. The satellite ring 90 provides a plurality of radially arranged satellite gears 92, with each satellite gear 92 being engaged with the central gear 88 and providing one of the flaps 86 thereon (it should be noted that one flap 86 is omitted in FIG. 8 for illustrative purposes). The second end 76 of each cable 72 is attached to the satellite ring 90 for selectively rotating the satellite ring 90 clockwise and counterclockwise about the stationary central gear 88 which rotates the satellite gears 92 and, in turn, the flaps 86 between the open position and the closed position. In at least one embodiment, the satellite ring 90 rides on a low-friction disk 94, such as a Teflon disk or ball bearings for example, in order to ease rotation of the satellite ring 90 about the central gear 88. It should be noted that the size, shape, quantity and positioning of flaps 86 depicted in the drawings is merely exemplary. In further embodiments, the flaps 86 may take on any other size, shape, quantity and/or positioning, now known or later developed, so long as the apparatus 20 is able to carry out the functionality described herein.

Figure 9:
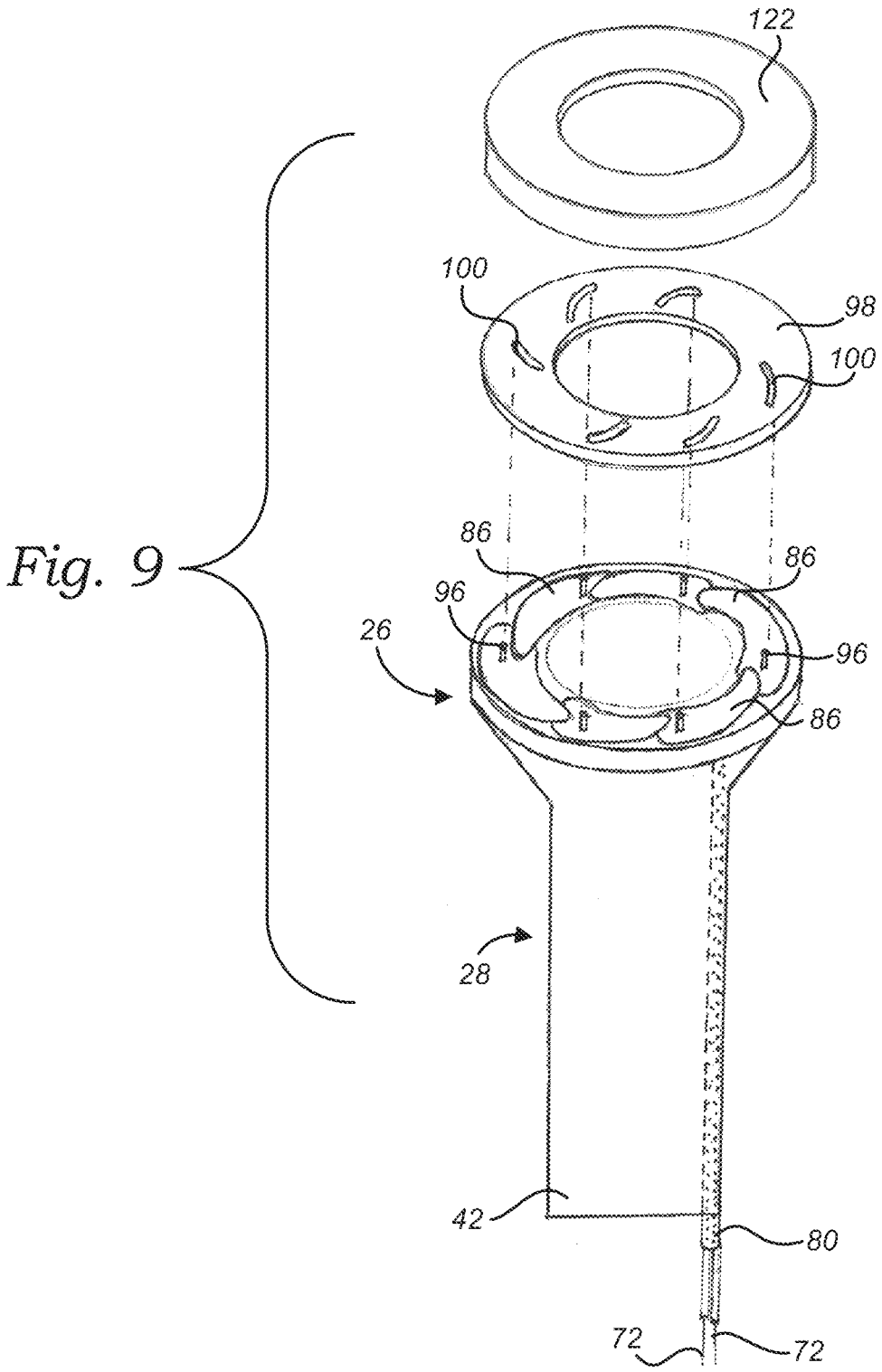
FIG. 9 is an exploded view of a further exemplary drain stopper apparatus, in accordance with at least one embodiment.

In at least one alternate embodiment, as illustrated in exploded view of FIG. 9, the plurality of radially arranged flaps 86 of the stopper 36 are rotatably mounted within the stopper body 26 using bushings or other mechanisms capable of allowing the flaps 86 to selectively rotate in place. Additionally, each flap 86 provides a perpendicularly extending flap post 96. In such embodiments, the stopper 36 further provides a control ring 98 that is selectively rotatable relative to the stopper body 26. The control ring 98 provides a plurality of elongate slots 100, with each slot 100 positioned and configured for receiving a flap post 96 of one of the flaps 86. The slots 100 are angled such that as the control ring 98 rotates clockwise and counterclockwise about the stopper body 26, the slots 100 cause the flaps 86 to rotate between the open position and the closed position. The second end 76 of each cable 72 is attached to the control ring 98 for selectively rotating the control ring 98 clockwise and counterclockwise about the stopper body 26. It again should be noted that the size, shape, quantity and positioning of flaps 86 and corresponding slots 100 depicted in the drawings is merely exemplary. In further embodiments, the flaps 86 and slots 100 may take on any other size, shape, quantity and/or positioning, now known or later developed, so long as the apparatus 20 is able to carry out the functionality described herein. Additionally, while the control ring 98 is depicted as being positioned above the flaps 86 in the drawings, in at least one alternate embodiment, the control ring 98 may be positioned below the flaps 86.

Figure 10:
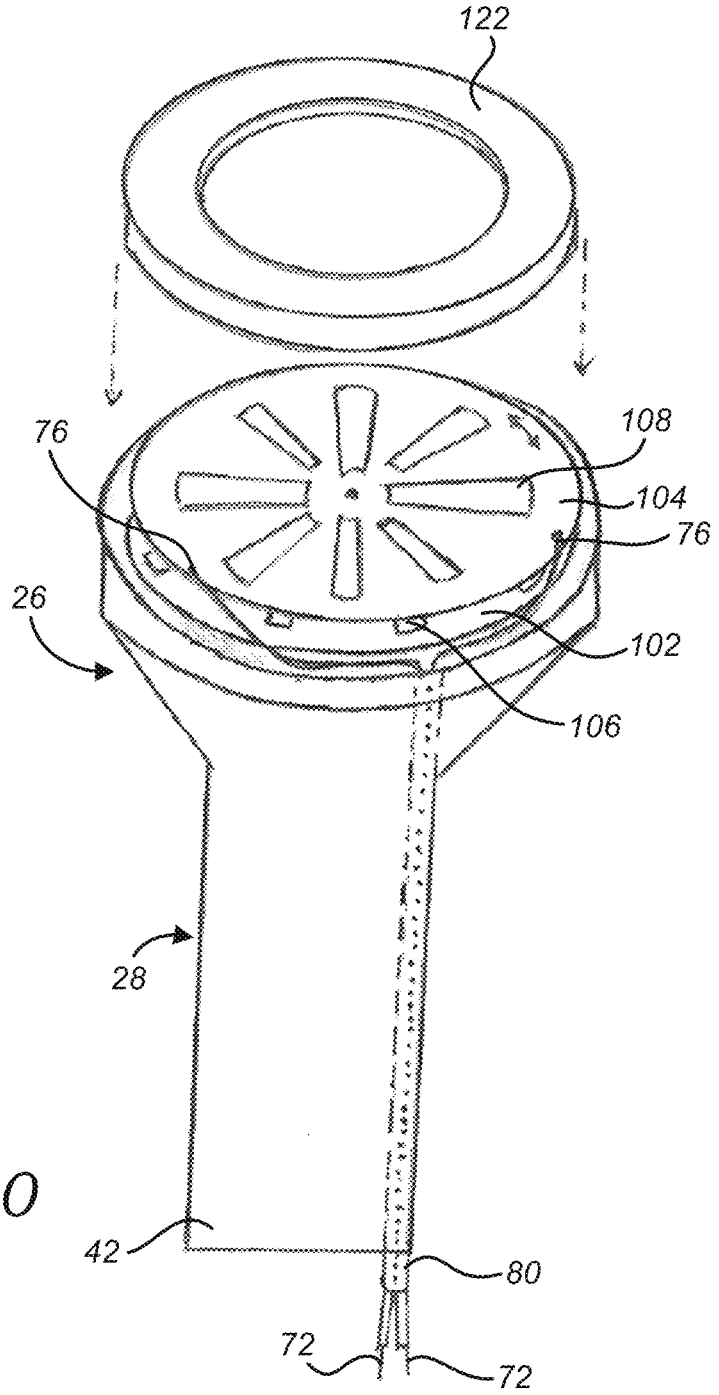
FIG. 10 is an exploded view of a still further exemplary drain stopper apparatus, in accordance with at least one embodiment.

In at least one further alternate embodiment, as illustrated in FIG. 10, the stopper 36 comprises a first disk 102 fixedly mounted within the stopper body 26, along with a second disk 104 rotatably engaged with the first disk 102. The first disk 102 provides an at least one first aperture 106 and the second disk 104 provides a corresponding at least one second aperture 108 through which fluid may freely flow when the first and second apertures 106 and 108 are aligned (i.e., when the stopper 36 is in the open position). When the stopper 36 is in the closed position, the second disk 104 is rotated relative to the first disk 102 so that the at least one second aperture 108 is no longer aligned with the corresponding at least one first aperture 106, thereby forming a fluid-tight seal between the first and second disks 102 and 104, which prevents fluid from flowing down through the stopper body 26. The second end 76 of each cable 72 is attached to the second disk 104 for selectively rotating the second disk 104 clockwise and counterclockwise relative to the first disk 102. It should be noted that the size, shape, quantity and positioning of first and second apertures 106 and 108 depicted in the drawings is merely exemplary. In further embodiments, the first and second apertures 106 and 108 may take on any other size, shape, quantity and/or positioning, now known or later developed, so long as the apparatus 20 is able to carry out the functionality described herein. Additionally, while the second disk 104 is depicted as being positioned above the first disk 102 in the drawings, in at least one alternate embodiment, the second disk 104 may be positioned below the first disk 102.

Figure 11:
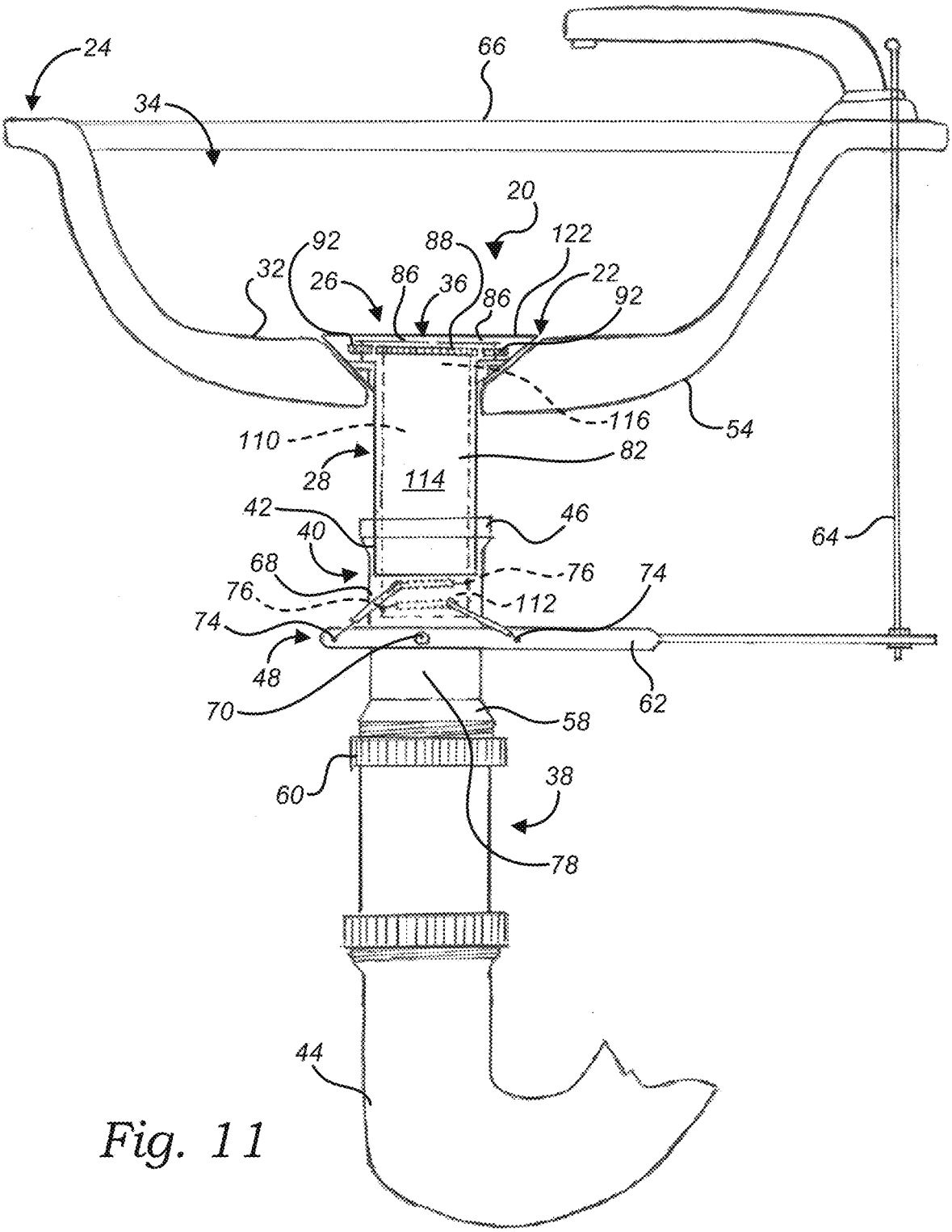
FIG. 11 is a side diagrammatic view of a still further exemplary drain stopper apparatus, in accordance with at least one embodiment.
Figure 12:
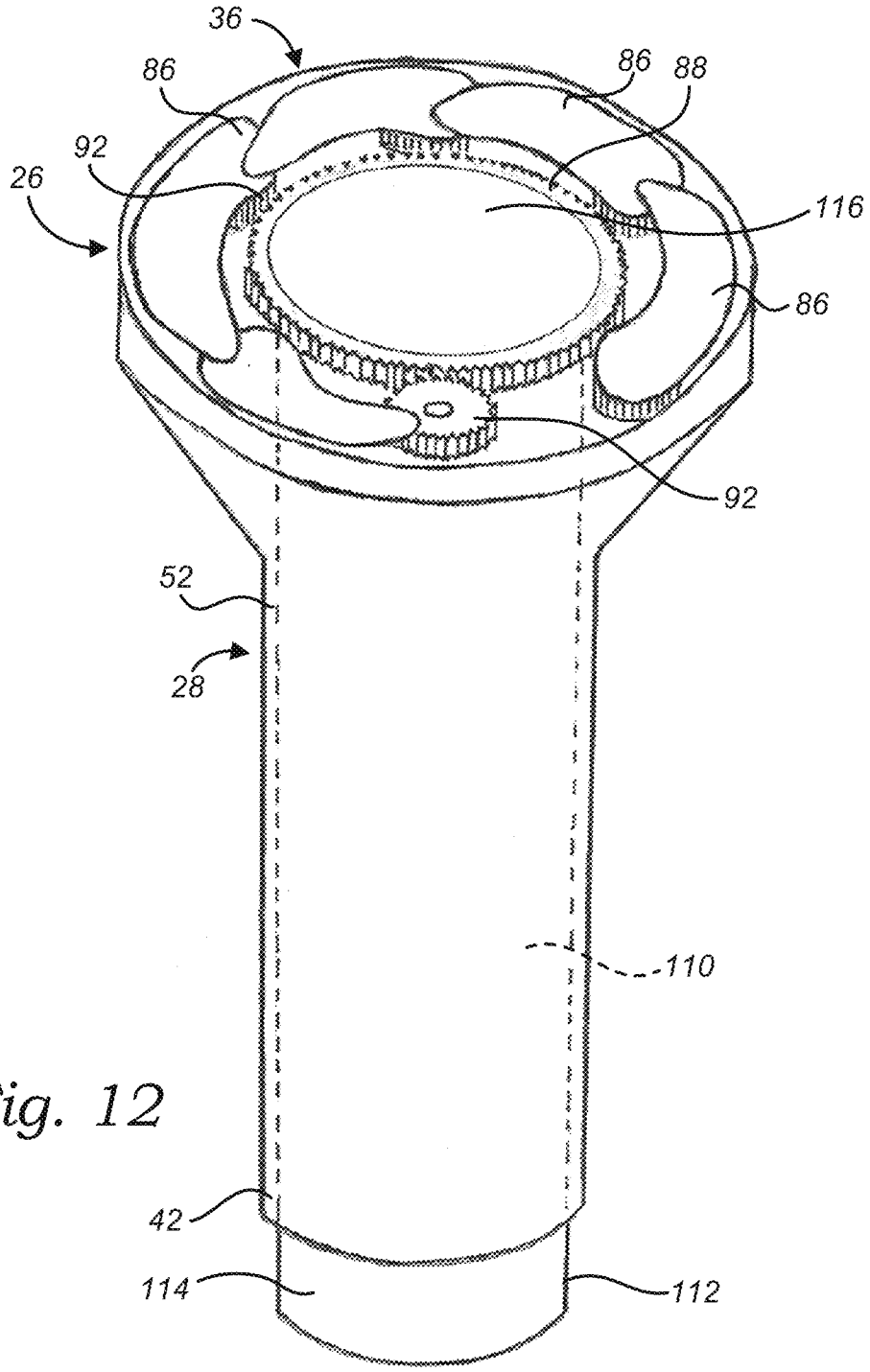
FIG. 12 is a perspective view of the drain stopper apparatus of FIG. 11, in accordance with at least one embodiment.

In at least one still further alternate embodiment, as illustrated in FIGS. 11 and 12, the stopper 36 provides an inner pipe 110 coaxially positioned within the stopper body 26 and stopper tailpiece 28. The inner pipe 110 is sized and configured for allowing fluid from the basin 34 to flow down through the inner pipe 110 when the stopper 36 is in the open position, as discussed further below. In at least one such embodiment, the inner pipe 110 has an outer diameter that approximates an inner diameter of the stopper tailpiece 28. As also discussed further below, a lower end 112 of the inner pipe 110 extends a distance beyond the lower end 42 of the stopper tailpiece 28, which allows the drive mechanism 48 to be mechanically linked to an outer surface 114 of the inner pipe 110, thereby leaving the stopper tailpiece 28, inner pipe 110, drive coupler 40 and drainpipe 38 free of any internal structure or components upon which hair or other materials may collect as fluid flows therethrough. In at least one such embodiment, the second end 76 of each cable 72 is attached to the outer surface 114 of the inner pipe 110 (preferably at a point below the lower end 42 of the stopper tailpiece 28) for selectively rotating the inner pipe 110 clockwise and counterclockwise relative to the stopper body 26 as the pivot rod 62 pivots back and forth about the pivot point 70 (with the cables 72 moving in a pull/follow fashion). Additionally, in at least one such embodiment, the stopper 36 is a mechanical iris similar to the embodiment described above and depicted in FIGS. 6 and 8. However, in the alternate embodiment of FIGS. 11 and 12, the plurality of radially arranged satellite gears 92 (along with the corresponding flaps 86) are rotatably mounted in place within the stopper body 26, while the central gear 88 is mounted on an upper end 116 of the inner pipe 110 so as to rotate with the inner pipe 110. Thus, as the inner pipe 110 selectively rotates clockwise and counterclockwise via the drive mechanism 48, the central gear 88 rotates the satellite gears 92 and, in turn, the flaps 86 between the open position and the closed position.

In at least one still further alternate embodiment (not shown), the inner pipe 110 is combined with a stopper 36 similar to that described above and depicted in FIG. 9. In at least one such embodiment, the control ring 98 is mounted on the upper end 116 of the inner pipe 110 so as to rotate with the inner pipe 110. Thus, as the inner pipe 110 (along with the control ring 98) selectively rotates clockwise and counterclockwise relative to the stopper body 26 via the drive mechanism 48, the slots 100 of the control ring 98 cause the flaps 86 to rotate between the open position and the closed position.

In at least one still further alternate embodiment (not shown), the inner pipe 110 is combined with a stopper 36 similar to that described above and depicted in FIG. 10. In at least one such embodiment, the second disk 104 is mounted on the upper end 116 of the inner pipe 110 so as to rotate with the inner pipe 110. Thus, as the inner pipe 110 (along with the second disk 104) selectively rotates clockwise and counterclockwise relative to the first disk 102 via the drive mechanism 48, the at least one second aperture 108 is rotated into and out of alignment with the corresponding at least one first aperture 106, thereby causing the stopper 36 to move between the open position and the closed position, respectively.

Figure 13:
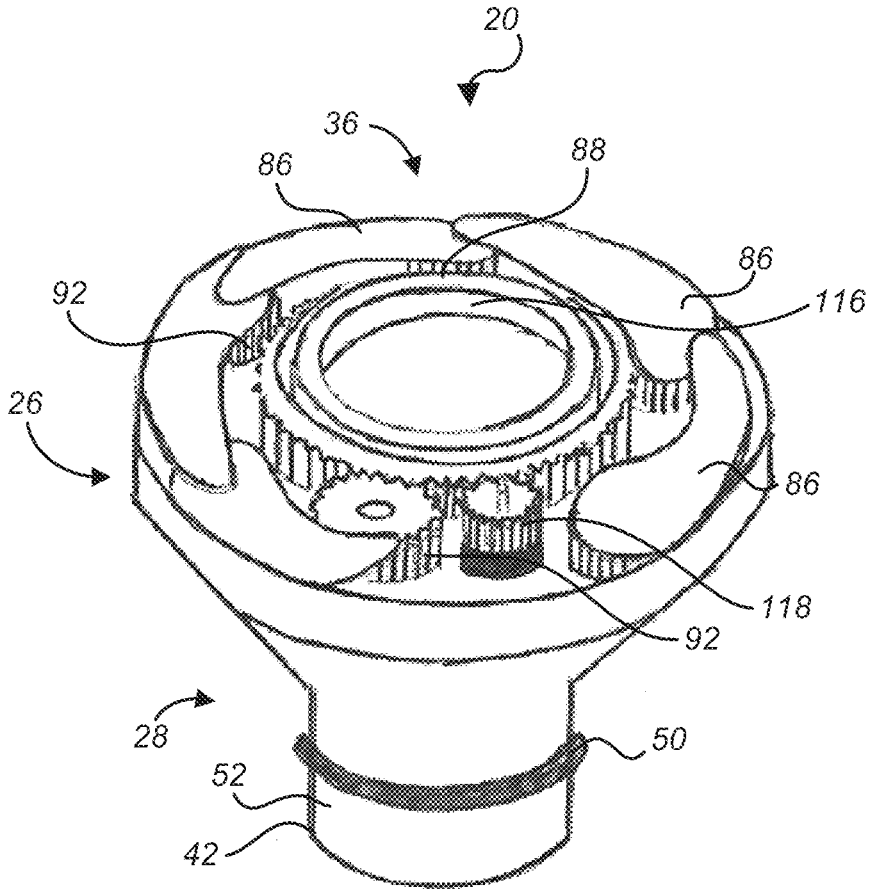
FIG. 13 is a perspective view of a still further exemplary drain stopper apparatus, in accordance with at least one embodiment.

In at least one still further alternate embodiment, as illustrated in FIG. 13, the apparatus 20 may omit the drive coupler 40, with the drive mechanism 48 instead being positioned within the stopper body 26. Additionally, in at least one such embodiment, the apparatus 20 may be installed by simply inserting the stopper tailpiece 28 down into the drain hole 22 of the fixture 24. In such embodiments, the stopper tailpiece 28 has an outer diameter that is relatively smaller than an inner diameter of the drain hole 22, and the outer surface 52 of the stopper tailpiece 28 provides a gasket 50 for creating a friction fit within the drain hole 22. In at least one such embodiment, the drive mechanism 48 is an electric motor 118 (powered by a battery, an AC power supply, a DC power supply, or any other compatible power source now known or later developed) that may be selectively triggered locally (via a button, for example) or remotely (via a wireless signal, for example). In at least one such embodiment, the stopper 36 is a mechanical iris similar to the embodiment described above and depicted in FIGS. 11 and 12. However, in the alternate embodiment of FIG. 13, the central gear 88 is rotatably mounted within the stopper body 26 and mechanically linked to the motor 118 so as to rotate when the motor 118 is operating. Thus, as the central gear 88 selectively rotates clockwise and counterclockwise via the motor 118, the central gear 88 rotates the satellite gears 92 and, in turn, the flaps 86 between the open position and the closed position.

In at least one still further alternate embodiment (not shown), the motor 118 is combined with a stopper 36 similar to that described above and depicted in FIG. 9. In at least one such embodiment, the control ring 98 is mechanically linked to the motor 118 so as to rotate when the motor 118 is operating. Thus, as the control ring 98 selectively rotates clockwise and counterclockwise relative to the stopper body 26 via the motor 118, the slots 100 of the control ring 98 cause the flaps 86 to rotate between the open position and the closed position.

In at least one still further alternate embodiment (not shown), the motor 118 is combined with a stopper 36 similar to that described above and depicted in FIG. 10. In at least one such embodiment, the second disk 104 is mechanically linked to the motor 118 so as to rotate when the motor 118 is operating. Thus, as the second disk 104 selectively rotates clockwise and counterclockwise relative to the first disk 102 via the motor 118, the at least one second aperture 108 is rotated into and out of alignment with the corresponding at least one first aperture 106, thereby causing the stopper 36 to move between the open position and the closed position, respectively.

Figure 14:
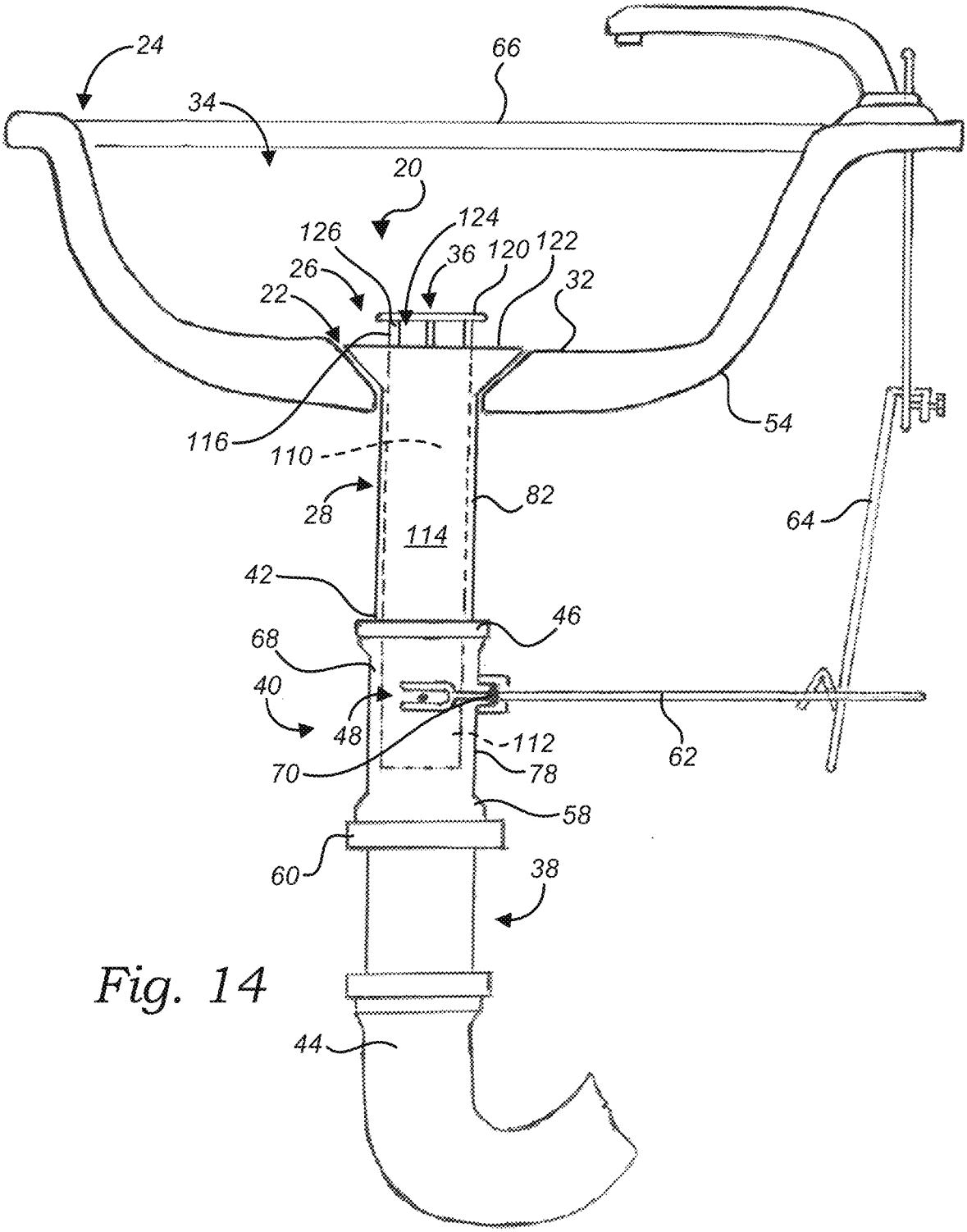
FIG. 14 is a side diagrammatic view of a still further exemplary drain stopper apparatus, in accordance with at least one embodiment.

In at least one still further alternate embodiment, as illustrated in FIG. 14, the stopper 36 is a pop-up, wherein the inner pipe 110 is slidably positioned within the stopper body 26 and stopper tailpiece 28, with the upper end 116 of the inner pipe 110 providing a cap 120 sized and configured for selectively providing a fluid-tight seal with the stopper body 26 when the stopper 36 is in the closed position. Similar to traditional pop-up stoppers, when the stopper 36 is in the open position, the cap 120 is elevated a distance above a top surface 122 of the stopper body 26, thereby exposing an at least one aperture 124 in a sidewall 126 of the inner pipe 110, allowing fluid to freely flow therethrough, into the inner pipe 110 and down into the drainpipe 38 below. In at least one such embodiment, the inner pipe 110 has an outer diameter that approximates an inner diameter of the stopper tailpiece 28. Additionally, in at least one embodiment, the lower end 112 of the inner pipe 110 extends a distance beyond the lower end 42 of the stopper tailpiece 28, which allows the drive mechanism 48 to be mechanically linked to the outer surface 114 of the inner pipe 110, thereby leaving the stopper tailpiece 28, inner pipe 110, drive coupler 40 and drainpipe 38 free of any internal structure or components upon which hair or other materials may collect as fluid flows therethrough. In at least one such embodiment, the pivot rod 62 is pivotally engaged proximally with the outer surface 114 of the inner pipe 110 (preferably at a point below the lower end 42 of the stopper tailpiece 28) for selectively moving the inner pipe 110 (and, in turn, the cap 120) vertically relative to the stopper body 26 as the pivot rod 62 pivots back and forth about the pivot point 70. Additionally, in at least one embodiment, a spring 128 is engaged between the stopper 36 and the drive coupler 40 for urging the stopper 36 into the open position.

Figure 15:
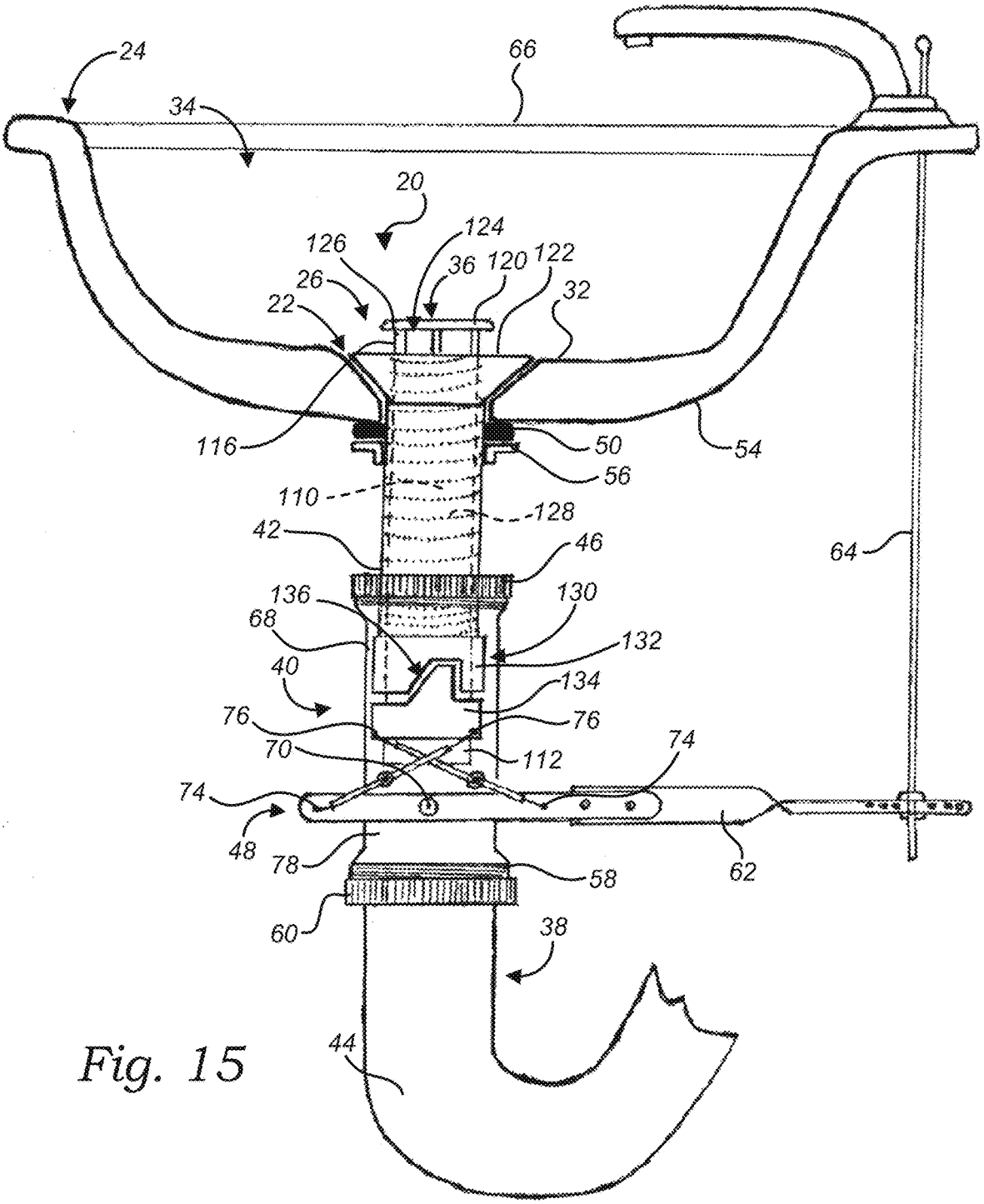
FIG. 15 is a side diagrammatic view of a still further exemplary drain stopper apparatus, in accordance with at least one embodiment.
Figure 16:
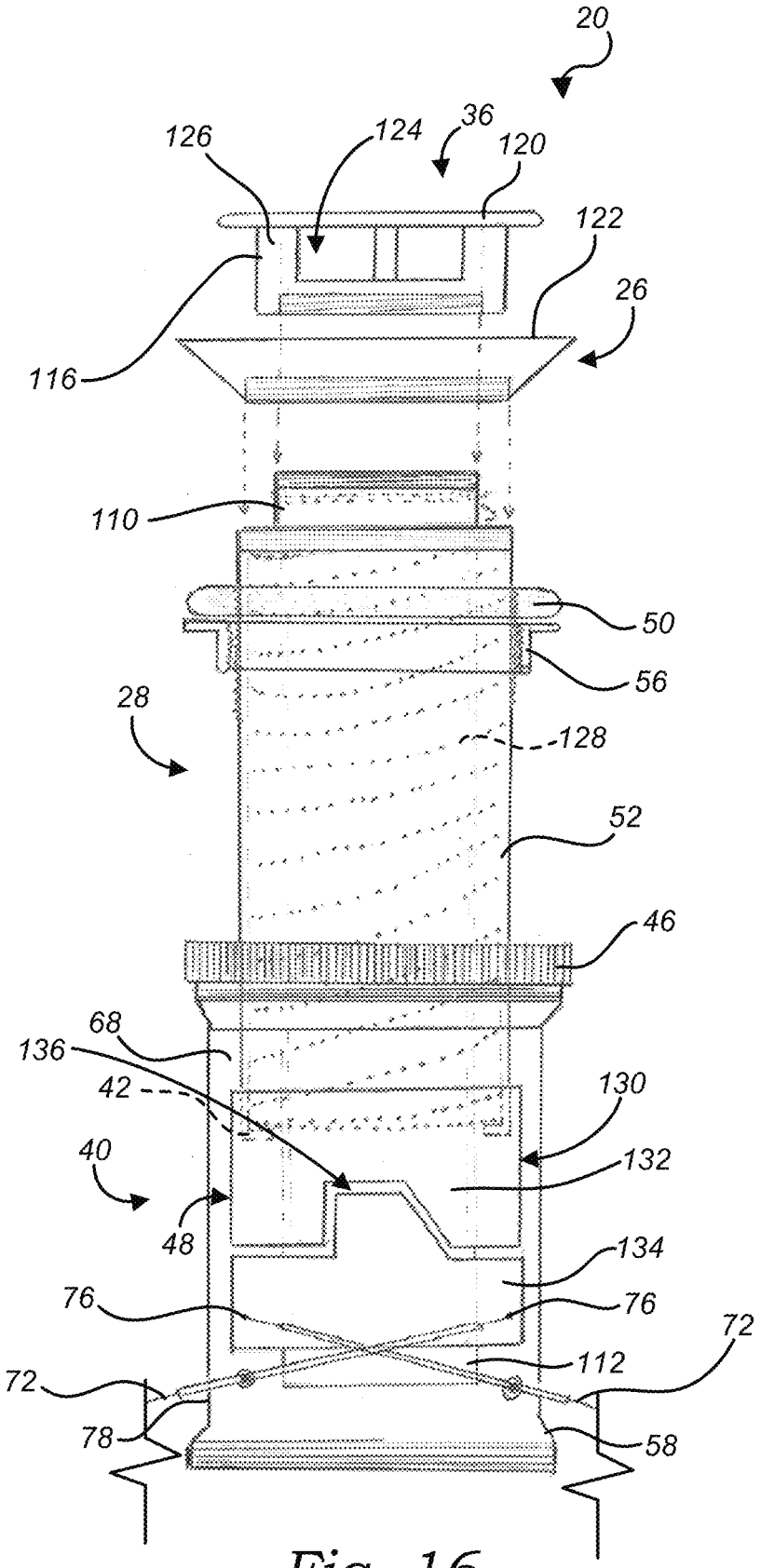
FIG. 16 is a partial exploded view of the drain stopper apparatus of FIG. 15, in accordance with at least one embodiment.

In at least one still further alternate embodiment, as illustrated in FIGS. 15 and 16, the drive coupler 40 provides a cylindrical cam 130 positioned therewithin. In at least one such embodiment, an upper half 132 of the cam 130 is rigidly secured within the drive coupler 40 (or alternatively, the upper half 132 of the cam 130 is rigidly secured to the lower end 42 of the stopper tailpiece 28), while a corresponding lower half 134 of the cam 130 is rigidly secured to the lower end 112 of the inner pipe 110. Accordingly, in such embodiments, the lower end 112 of the inner pipe 110 extends a distance beyond the lower end 42 of the stopper tailpiece 28, which allows the drive mechanism 48 to be mechanically linked to the lower half 134 of the cam 130, thereby leaving the stopper tailpiece 28, inner pipe 110, drive coupler 40 and drainpipe 38 free of any internal structure or components upon which hair or other materials may collect as fluid flows therethrough. In at least one such embodiment, the second end 76 of each cable 72 is attached to the lower half 134 of the cam 130 for selectively rotating the lower half 134 clockwise and counterclockwise relative to the upper half 132 of the cam 130 as the pivot rod 62 pivots back and forth about the pivot point 70 (with the cables 72 moving in a pull/follow fashion). Additionally, in at least one embodiment, a spring 128 is engaged between the stopper 36 and the drive coupler 40 for urging the stopper 36 into the open position. As a result, when the lower half 134 of the cam 130 is rotated (via the pivot rod 62) out of a corresponding notch 136 provided by the upper half 132 of the cam 130, the stopper 36 is pulled down into the closed position; and when the lower half 134 is rotated (via the pivot rod 62) back into the notch 136, the stopper 36 is urged back into the open position.

Figure 17:
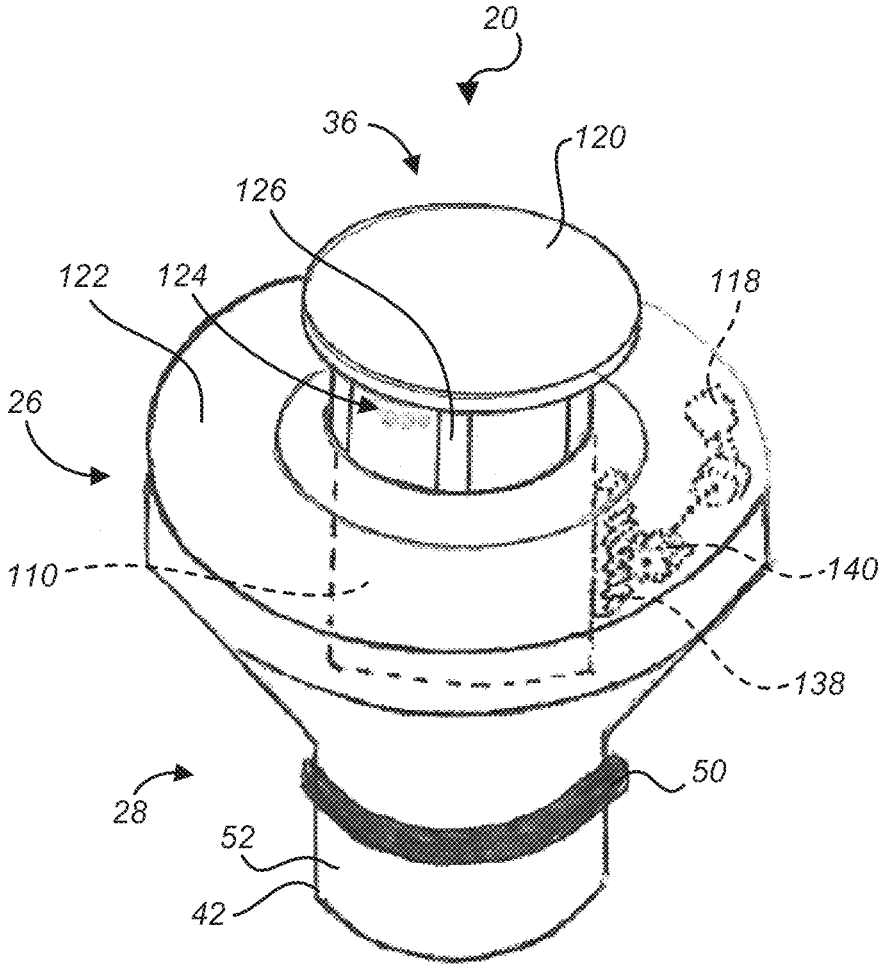
FIG. 17 is a perspective view of a still further exemplary drain stopper apparatus, in accordance with at least one embodiment.

In at least one still further alternate embodiment, as illustrated in FIG. 17, similar to the embodiment described above and depicted in FIG. 13, the apparatus 20 may omit the drive coupler 40, with the drive mechanism 48 instead being an electric motor 118 positioned within the stopper body 26. Additionally, in at least one such embodiment, the apparatus 20 may be installed by simply inserting the stopper tailpiece 28 down into the drain hole 22 of the fixture 24. In such embodiments, the stopper tailpiece 28 has an outer diameter that is relatively smaller than an inner diameter of the drain hole 22, and the outer surface 52 of the stopper tailpiece 28 provides a gasket 50 for creating a friction fit within the drain hole 22. In at least one such embodiment, the inner pipe 110 is slidably positioned within the stopper body 26 and stopper tailpiece 28, while also being mechanically linked to the motor 118, such as by a rack 138 and pinion 140 for example. Accordingly, in such embodiments, the motor 118 is capable of selectively moving the inner pipe 110 (and, in turn, the cap 120 of the stopper 36) vertically relative to the stopper body 26, between the open position and the closed position.

In still further embodiments, any other mechanisms, now known or later developed, capable of selectively actuating the stopper 36 and moving it between the open and closed positions, may be substituted.

Aspects of the present specification may also be described as the following embodiments:

1. A drain stopper apparatus for being installed within a drain hole of a fixture, the drain hole in fluid communication with a drainpipe, the apparatus comprising: a stopper body sized and shaped for being positioned within the drain hole of the fixture, in contact with an inner surface of a basin of the fixture; a stopper tailpiece engaged with a bottom of the stopper body; a stopper positioned within the stopper body and configured for selectively moving between one of an open position—wherein fluid is able to freely flow down through each of the stopper body, stopper tailpiece and drainpipe—and a closed position—wherein fluid is prevented from flowing down through the stopper body; a drive coupler interconnecting a lower end of the stopper tailpiece with an upper end of the drainpipe, the drive coupler providing a drive mechanism positioned and configured for selectively actuating the stopper between the open and closed positions; the drive mechanism providing a pivot rod pivotally mounted proximally to an outer surface of the drive coupler at a pivot point; and a pair of cables extending between the pivot rod and the stopper within an enclosed cable passage positioned within the stopper tailpiece, a first end of each cable attached to the pivot rod so as to flank the pivot point, and an opposing second end of each cable attached to the stopper, wherein as the pivot rod pivots back and forth about the pivot point, the cables move in a pull/follow fashion which, in turn, cause the stopper to move between the open position and closed position; whereby, the stopper body, stopper tailpiece, drive coupler and drainpipe remain substantially unobstructed when the stopper is in the open position, thereby preventing any buildup of hair or other materials therewithin as fluid flows therethrough.

2. The drain stopper apparatus according to embodiment 1, wherein the bottom of the stopper body is removably engagable with the stopper tailpiece.

3. The drain stopper apparatus according to embodiments 1-2, wherein an upper end of the drive coupler is removably engagable with the lower end of the stopper tailpiece.

4. The drain stopper apparatus according to embodiments 1-3, wherein the pivot rod is attached distally to a pull rod accessible from a top surface of the fixture, thereby allowing the pull rod to be manually pulled and pushed which, in turn, pivots the pivot rod relative to the drive coupler.

5. The drain stopper apparatus according to embodiments 1-4, wherein the first end of each cable extends through a sidewall of the drive coupler to attach to the pivot rod.

6. The drain stopper apparatus according to embodiments 1-5, wherein the cable passage is positioned within a sidewall of the stopper tailpiece.

7. The drain stopper apparatus according to embodiments 1-6, wherein the cable passage is a small diameter tube that runs along an inner surface of the stopper tailpiece.

8. The drain stopper apparatus according to embodiments 1-7, wherein the stopper is a mechanical iris comprising a plurality of radially arranged rotatable flaps, whereby when the stopper is in the closed position, the flaps are rotated inwardly and cooperate to form a fluid-tight seal, thereby preventing fluid from flowing down through the stopper body, and when the stopper is in the open position, the flaps are rotated outwardly, thereby allowing fluid to freely flow down through each of the stopper body, stopper tailpiece and drainpipe.

9. The drain stopper apparatus according to embodiments 1-8, wherein the stopper further comprises: a stationary central gear surrounded by a selectively rotatable satellite ring; and a plurality of satellite gears radially arranged on the satellite ring, each satellite gear engaged with the central gear and providing one of the flaps thereon; wherein the second end of each cable is attached to the satellite ring for selectively rotating the satellite ring clockwise and counterclockwise about the stationary central gear, which rotates the satellite gears and, in turn, the flaps between the open position and the closed position.

10. The drain stopper apparatus according to embodiments 1-9, wherein the satellite ring rides on a low-friction disk in order to ease rotation of the satellite ring about the central gear.

11. The drain stopper apparatus according to embodiments 1-10, wherein: the flaps are rotatably mounted within the stopper body so as to selectively rotate in place; each flap provides a perpendicularly extending flap post; the stopper further provides a control ring that is selectively rotatable relative to the stopper body, the control ring providing a plurality of elongate slots, with each slot positioned and configured for slidably receiving a flap post of one of the flaps; and the second end of each cable is attached to the control ring for selectively rotating the control ring clockwise and counterclockwise about the stopper body, such that the slots cause the flaps to rotate between the open position and the closed position.

12. The drain stopper apparatus according to embodiments 1-11, wherein: the stopper comprises a first disk fixedly mounted within the stopper body, along with a second disk rotatably engaged with the first disk; and the first disk provides an at least one first aperture and the second disk provides a corresponding at least one second aperture; wherein the second end of each cable is attached to the second disk for selectively rotating the second disk clockwise and counterclockwise relative to the first disk which, in turn, rotates the stopper between the open position—wherein the first and second apertures are aligned so as to allow fluid to freely flow therethrough—and the closed position—wherein the at least one second aperture is no longer aligned with the corresponding at least one first aperture, thereby forming a fluid-tight seal between the first and second disks.

13. The drain stopper apparatus according to embodiments 1-12, wherein the stopper provides an inner pipe coaxially positioned within the stopper body and stopper tailpiece, the inner pipe sized and configured for allowing fluid to freely flow down through each of the inner pipe and drainpipe when the stopper is in the open position.

14. The drain stopper apparatus according to embodiments 1-13, wherein the inner pipe has an outer diameter that approximates an inner diameter of the stopper tailpiece.

15. The drain stopper apparatus according to embodiments 1-14, wherein: a lower end of the inner pipe extends a distance beyond a lower end of the stopper tailpiece; and the drive mechanism is mechanically linked to an outer surface of the inner pipe.

16. The drain stopper apparatus according to embodiments 1-15, wherein the second end of each cable is attached to the outer surface of the inner pipe at a point below the lower end of the stopper tailpiece for selectively rotating the inner pipe clockwise and counterclockwise relative to the stopper body as the pivot rod pivots back and forth about the pivot point, thereby moving the stopper between the open position and closed position.

17. The drain stopper apparatus according to embodiments 1-16, wherein the stopper is a mechanical iris comprising: a central gear mounted on an upper end of the inner pipe so as to rotate with the inner pipe; and a plurality of satellite gears radially arranged about the central gear and rotatably mounted within the stopper body so as to selectively rotate in place, each satellite gear engaged with the central gear and providing a flap thereon, whereby when the stopper is in the closed position, the flaps are rotated inwardly and cooperate to form a fluid-tight seal, thereby preventing fluid from flowing down through the inner pipe, and when the stopper is in the open position, the flaps are rotated outwardly, thereby allowing fluid to freely flow down through each of the inner pipe and drainpipe.

18. The drain stopper apparatus according to embodiments 1-17, wherein the stopper is a mechanical iris comprising: a plurality of radially arranged rotatable flaps mounted within the stopper body so as to selectively rotate in place, whereby when the stopper is in the closed position, the flaps are rotated inwardly and cooperate to form a fluid-tight seal, thereby preventing fluid from flowing down through the inner pipe, and when the stopper is in the open position, the flaps are rotated outwardly, thereby allowing fluid to freely flow down through each of the inner pipe and drainpipe; each flap providing a perpendicularly extending flap post; a control ring mounted on an upper end of the inner pipe so as to rotate with the inner pipe, the control ring providing a plurality of elongate slots, with each slot positioned and configured for slidably receiving a flap post of one of the flaps so as to cause the flaps to rotate between the open position and the closed position as the control ring is rotated.

19. The drain stopper apparatus according to embodiments 1-18, wherein: the stopper comprises a first disk fixedly mounted within the stopper body, along with a second disk mounted on an upper end of the inner pipe so as to rotate with the inner pipe; and the first disk provides an at least one first aperture and the second disk provides a corresponding at least one second aperture; whereby, the inner pipe rotates the second disk clockwise and counterclockwise relative to the first disk which, in turn, rotates the stopper between the open position—wherein the first and second apertures are aligned so as to allow fluid to freely flow therethrough—and the closed position—wherein the at least one second aperture is no longer aligned with the corresponding at least one first aperture, thereby forming a fluid-tight seal between the first and second disks.

20. A drain stopper apparatus for being installed within a drain hole of a fixture, the drain hole in fluid communication with a drainpipe, the apparatus comprising: a stopper body sized and shaped for being positioned within the drain hole of the fixture, in contact with an inner surface of a basin of the fixture; a stopper tailpiece engaged with a bottom of the stopper body; a drive coupler interconnecting a lower end of the stopper tailpiece with an upper end of the drainpipe; a stopper comprising: an inner pipe coaxially and slidably positioned within the stopper body and stopper tailpiece, the inner pipe sized and configured for selectively allowing fluid to freely flow down through each of the inner pipe, drive coupler and drainpipe; the inner pipe having an outer diameter that approximates an inner diameter of the stopper tailpiece, with a lower end of the inner pipe extending a distance beyond a lower end of the stopper tailpiece; a cap positioned on an upper end of the inner pipe; and an at least one aperture positioned on a sidewall of the inner pipe, below the cap; and the drive coupler providing a drive mechanism mechanically linked to an outer surface of the inner pipe at a point below the lower end of the stopper tailpiece; the drive mechanism providing a pivot rod pivotally mounted proximally to an outer surface of the drive coupler at a pivot point; whereby, as the pivot rod pivots back and forth about the pivot point, the drive mechanism is configured for selectively moving the stopper vertically relative to the stopper body between one of a closed position—wherein the cap creates a fluid-tight seal with the stopper body—and an open position—wherein the cap is elevated a distance above a top surface of the stopper body, thereby exposing the at least one aperture in the sidewall of the inner pipe, allowing fluid to freely flow therethrough, into the inner pipe and down into the drainpipe, with the stopper body, stopper tailpiece, drive coupler, inner pipe and drainpipe remaining substantially unobstructed when the stopper is in the open position, thereby preventing any buildup of hair or other materials therewithin as fluid flows therethrough.

21. The drain stopper apparatus according to embodiment 20, wherein the bottom of the stopper body is removably engagable with the stopper tailpiece.

22. The drain stopper apparatus according to embodiments 20-21, wherein an upper end of the drive coupler is removably engagable with the lower end of the stopper tailpiece.

23. The drain stopper apparatus according to embodiments 20-22, wherein the pivot rod is attached distally to a pull rod accessible from a top surface of the fixture, thereby allowing the pull rod to be manually pulled and pushed which, in turn, pivots the pivot rod relative to the drive coupler.

24. The drain stopper apparatus according to embodiments 20-23, further comprising a spring engaged between the stopper and the drive coupler for urging the stopper into the open position.

25. The drain stopper apparatus according to embodiments 20-24, wherein the pivot rod is further pivotally mounted to the outer surface of the inner pipe at a point below the lower end of the stopper tailpiece.

26. The drain stopper apparatus according to embodiments 20-25, further comprising: a cylindrical cam positioned within the drive coupler, with an upper half of the cam being rigidly positioned within the drive coupler, and a corresponding lower half of the cam being rigidly secured to the lower end of the inner pipe; a pair of cables, a first end of each cable attached to the pivot rod so as to flank the pivot point, and an opposing second end of each cable extending through a sidewall of the drive coupler and attached to the lower half of the cam, wherein as the pivot rod pivots back and forth about the pivot point, the cables move in a pull/follow fashion which, in turn, rotates the lower half of the cam clockwise and counterclockwise relative to the upper half of the cam; and a spring engaged between the stopper and the drive coupler for urging the stopper into the open position; whereby, when the lower half of the cam is rotated out of a corresponding notch provided by the upper half of the cam, the stopper is pulled down into the closed position, and when the lower half is rotated back into the notch, the stopper is urged back into the open position.

27. A drain stopper apparatus for being installed within a drain hole of a fixture, the drain hole in fluid communication with a drainpipe, the apparatus comprising: a stopper body sized and shaped for being positioned within the drain hole of the fixture, in contact with an inner surface of a basin of the fixture; a stopper tailpiece engaged with a bottom of the stopper body and extending a distance into the drain hole, the stopper tailpiece having an outer diameter that is relatively smaller than an inner diameter of the drain hole; a stopper positioned within the stopper body and configured for selectively moving between one of an open position—wherein fluid is able to freely flow down through each of the stopper body, stopper tailpiece and drainpipe—and a closed position—wherein fluid is prevented from flowing down through the stopper body; and an electric motor positioned within the stopper body and mechanically linked to the stopper for selectively moving the stopper between the open position and closed position; whereby, the stopper body, stopper tailpiece and drainpipe remain substantially unobstructed when the stopper is in the open position, thereby preventing any buildup of hair or other materials therewithin as fluid flows therethrough.

28. The drain stopper apparatus according to embodiment 27, wherein an outer surface of the stopper tailpiece provides a gasket for creating a friction fit within the drain hole.

29. The drain stopper apparatus according to embodiments 27-28, wherein the motor is powered by at least one of a battery, an AC power supply, and a DC power supply.

30. The drain stopper apparatus according to embodiments 27-29, wherein the motor is configured for being selectively triggered locally.

31. The drain stopper apparatus according to embodiments 27-30, wherein the motor is configured for being selectively triggered remotely.

32. The drain stopper apparatus according to embodiments 27-31, wherein the stopper is a mechanical iris comprising: a central gear rotatably mounted within the stopper body and mechanically linked to the motor for selectively rotating the central gear clockwise and counterclockwise relative to the stopper body; and a plurality of satellite gears radially arranged about the central gear and rotatably mounted within the stopper body so as to selectively rotate in place, each satellite gear engaged with the central gear and providing a flap thereon, whereby when the stopper is in the closed position, the flaps are rotated inwardly and cooperate to form a fluid-tight seal, thereby preventing fluid from flowing down through the stopper body, and when the stopper is in the open position, the flaps are rotated outwardly, thereby allowing fluid to freely flow down through each of the stopper body, stopper tailpiece and drainpipe.

33. The drain stopper apparatus according to embodiments 27-32, wherein the stopper is a mechanical iris comprising: a plurality of radially arranged rotatable flaps mounted within the stopper body so as to selectively rotate in place, whereby when the stopper is in the closed position, the flaps are rotated inwardly and cooperate to form a fluid-tight seal, thereby preventing fluid from flowing down through the inner pipe, and when the stopper is in the open position, the flaps are rotated outwardly, thereby allowing fluid to freely flow down through each of the inner pipe and drainpipe; each flap providing a perpendicularly extending flap post; and a control ring rotatably mounted within the stopper body and mechanically linked to the motor for selectively rotating the control ring clockwise and counterclockwise relative to the stopper body, the control ring providing a plurality of elongate slots, with each slot positioned and configured for slidably receiving a flap post of one of the flaps so as to cause the flaps to rotate between the open position and the closed position as the control ring is rotated.

34. The drain stopper apparatus according to embodiments 27-33, wherein: the stopper comprises a first disk fixedly mounted within the stopper body, along with a second disk rotatably engaged with the first disk; the second disk is mechanically linked to the motor; and the first disk provides an at least one first aperture and the second disk provides a corresponding at least one second aperture; whereby, the motor causes the second disk to rotate clockwise and counterclockwise relative to the first disk which, in turn, rotates the stopper between the open position—wherein the first and second apertures are aligned so as to allow fluid to freely flow therethrough—and the closed position—wherein the at least one second aperture is no longer aligned with the corresponding at least one first aperture, thereby forming a fluid-tight seal between the first and second disks.

35. The drain stopper apparatus according to embodiments 27-34, wherein the stopper comprises: an inner pipe coaxially and slidably positioned within the stopper body and stopper tailpiece, the inner pipe sized and configured for selectively allowing fluid to freely flow down through each of the inner pipe and drainpipe; the inner pipe having an outer diameter that approximates an inner diameter of the stopper tailpiece; a cap positioned on an upper end of the inner pipe; an at least one aperture positioned on a sidewall of the inner pipe, below the cap; and the inner pipe mechanically linked to the motor for moving the stopper vertically relative to the stopper body between one of a closed position—wherein the cap creates a fluid-tight seal with the stopper body—and an open position—wherein the cap is elevated a distance above a top surface of the stopper body, thereby exposing the at least one aperture in the sidewall of the inner pipe, allowing fluid to freely flow therethrough, into the inner pipe and down into the drainpipe.

36. The drain stopper apparatus according to embodiments 27-35, wherein the inner pipe is mechanically linked to the motor via a rack and pinion.

In closing, regarding the exemplary embodiments of the present invention as shown and described herein, it will be appreciated that a drain stopper apparatus is disclosed and configured for keeping the drainpipe substantially unobstructed when the apparatus is in an open position, thereby preventing any buildup of hair or other materials therewithin. Because the principles of the invention may be practiced in a number of configurations beyond those shown and described, it is to be understood that the invention is not in any way limited by the exemplary embodiments, but is generally directed to a drain stopper apparatus and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein. Similarly, as used herein, unless indicated to the contrary, the term "substantially" is a term of degree intended to indicate an approximation of the characteristic, item, quantity, parameter, property, or term so qualified, encompassing a range that can be understood and construed by those of ordinary skill in the art.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

Any claims intended to be treated under 35 U.S.C. § 112(f) will begin with the words "means for," but use of the term "for" in any other context is not intended to invoke treatment under 35 U.S.C. § 112(f). Accordingly, Applicant reserves the right to pursue additional claims after filing this application, in either this application or in a continuing application.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to Applicant and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A drain stopper apparatus for being installed within a drain hole of a fixture, the drain hole in fluid communication with a drainpipe, the apparatus comprising:

a stopper body sized and shaped for being positioned within the drain hole of the fixture, in contact with an inner surface of a basin of the fixture;

a stopper tailpiece engaged with a bottom of the stopper body;

a stopper positioned within the stopper body and configured for selectively moving between one of an open position—wherein fluid is able to freely flow down through each of the stopper body, stopper tailpiece and drainpipe—and a closed position—wherein fluid is prevented from flowing down through the stopper body;

a drive coupler interconnecting a lower end of the stopper tailpiece with an upper end of the drainpipe, the drive coupler providing a drive mechanism positioned and configured for selectively actuating the stopper between the open and closed positions;

the drive mechanism providing a pivot rod pivotally mounted proximally to an outer surface of the drive coupler at a pivot point; and a pair of cables extending between the pivot rod and the stopper within an enclosed cable passage positioned within the stopper tailpiece, a first end of each cable attached to the pivot rod so as to flank the pivot point, and an opposing second end of each cable attached to the stopper, wherein as the pivot rod pivots back and forth about the pivot point, the cables move in a pull/follow fashion which, in turn, cause the stopper to move between the open position and closed position;

whereby, the stopper body, stopper tailpiece, drive coupler and drainpipe remain substantially unobstructed when the stopper is in the open position, thereby preventing any buildup of hair or other materials therewithin as fluid flows therethrough.

2. The drain stopper apparatus of claim 1, wherein the pivot rod is attached distally to a pull rod accessible from a top surface of the fixture, thereby allowing the pull rod to be manually pulled and pushed which, in turn, pivots the pivot rod relative to the drive coupler.

3. The drain stopper apparatus of claim 1, wherein the cable passage is positioned within a sidewall of the stopper tailpiece.

4. The drain stopper apparatus of claim 1, wherein the cable passage is a small diameter tube that runs along an inner surface of the stopper tailpiece.

5. The drain stopper apparatus of claim 1, wherein the stopper is a mechanical iris comprising a plurality of radially arranged rotatable flaps, whereby when the stopper is in the closed position, the flaps are rotated inwardly and cooperate to form a fluid-tight seal, thereby preventing fluid from flowing down through the stopper body, and when the stopper is in the open position, the flaps are rotated outwardly, thereby allowing fluid to freely flow down through each of the stopper body, stopper tailpiece and drainpipe.

6. The drain stopper apparatus of claim 5, wherein the stopper further comprises:

a stationary central gear surrounded by a selectively rotatable satellite ring; and a plurality of satellite gears radially arranged on the satellite ring, each satellite gear engaged with the central gear and providing one of the flaps thereon;

wherein the second end of each cable is attached to the satellite ring for selectively rotating the satellite ring clockwise and counterclockwise about the stationary central gear, which rotates the satellite gears and, in turn, the flaps between the open position and the closed position.

7. The drain stopper apparatus of claim 1, wherein the stopper provides an inner pipe coaxially positioned within the stopper body and stopper tailpiece, the inner pipe sized and configured for allowing fluid to freely flow down through each of the inner pipe and drainpipe when the stopper is in the open position.

8. The drain stopper apparatus of claim 7, wherein the inner pipe has an outer diameter that approximates an inner diameter of the stopper tailpiece.

9. The drain stopper apparatus of claim 7, wherein:

a lower end of the inner pipe extends a distance beyond a lower end of the stopper tailpiece; and the drive mechanism is mechanically linked to an outer surface of the inner pipe.

10. The drain stopper apparatus of claim 9, wherein the second end of each cable is attached to the outer surface of the inner pipe at a point below the lower end of the stopper tailpiece for selectively rotating the inner pipe clockwise and counterclockwise relative to the stopper body as the pivot rod pivots back and forth about the pivot point, thereby moving the stopper between the open position and closed position.

11. The drain stopper apparatus of claim 10, wherein the stopper is a mechanical iris comprising:

a central gear mounted on an upper end of the inner pipe so as to rotate with the inner pipe; and a plurality of satellite gears radially arranged about the central gear and rotatably mounted within the stopper body so as to selectively rotate in place, each satellite gear engaged with the central gear and providing a flap thereon, whereby when the stopper is in the closed position, the flaps are rotated inwardly and cooperate to form a fluid-tight seal, thereby preventing fluid from flowing down through the inner pipe, and when the stopper is in the open position, the flaps are rotated outwardly, thereby allowing fluid to freely flow down through each of the inner pipe and drainpipe.

* * * * *